US012735956B2

(12) United States Patent
Sequera et al.

(10) Patent No.: US 12,735,956 B2
(45) Date of Patent: Sep. 15, 2026

(54) CONVERTIBLE AUTOFILL FLOAT EQUIPMENT HAVING POPPET VALVE AND INTERLOCK

(71) Applicant: Weatherford International, LLC, Houston, TX (US)

(72) Inventors: Daniel E. Sequera, Houston, TX (US); Joshua V. Symms, Cypress, TX (US); Brandon C. Goodman, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 19/172,265

(22) Filed: Apr. 7, 2025

(65) Prior Publication Data

US 2026/0266160 A1 Sep. 10, 2026

Related U.S. Application Data

(60) Provisional application No. 63/767,362, filed on Mar. 5, 2025.

(51) Int. Cl.
*E21B 34/10* (2006.01)
*E21B 34/06* (2006.01)

(52) U.S. Cl.
CPC ..... *E21B 34/102* (2013.01); *E21B 34/063* (2013.01)

(58) Field of Classification Search
CPC ..... E21B 34/102; E21B 34/103
See application file for complete search history.

(56) References Cited

U.S. PATENT DOCUMENTS 3,385,370 A 5/1968 Lloyd et al.
3,385,372 A * 5/1968 Knox ..... E21B 21/10 137/515
3,409,078 A 11/1968 Lloyd et al.
3,776,250 A 12/1973 Knox
4,067,358 A 1/1978 Streich
(Continued)

FOREIGN PATENT DOCUMENTS

AU 2015409660 A1 2/2018
CN 116971757 A * 10/2023 ..... E21B 43/26

OTHER PUBLICATIONS

Int'l Search Report and Written Opinion in PCT/US2026/010112, mailed Apr. 7, 2026, 9 pgs.

*Primary Examiner* — Kenneth L Thompson
(74) *Attorney, Agent, or Firm* — Cabello Hall Zinda, PLLC

(57) ABSTRACT

A float assembly facilitates autofill operations when running a tubing string into a wellbore. The assembly includes a poppet valve and an interlock. A primary biasing element, located on a support within the assembly, moves the poppet from an open position to a closed position against a seat. The interlock, situated relative to the poppet and support, includes a surface area exposed to fluid flow and includes a secondary biasing element. When fluid flow in the downbore direction exceeds a specific threshold, the interlock shifts from a locked state to an unlocked state. In the locked state, the interlock holds the poppet in the open position, allowing bidirectional fluid flow to support autofill operations. The secondary biasing element, located between the support and the assembly, maintains the locked state. When unlocked, the interlock releases the poppet, and the primary biasing element drives the poppet closed.

21 Claims, 11 Drawing Sheets

(56) References Cited

U.S. PATENT DOCUMENTS

| | | | |
|---|---|---|---|
| 4,625,762 | A | 12/1986 | Hassanzadeh et al. |
| 4,683,955 | A | 8/1987 | Stepp et al. |
| 4,738,282 | A | 4/1988 | Boehringer |
| 5,209,253 | A | 5/1993 | Taylor |
| 5,411,049 | A | 5/1995 | Colvard |
| 6,279,552 | B1 | 8/2001 | Okada et al. |
| 6,622,795 | B2 | 9/2003 | Hebert et al. |
| 7,527,104 | B2 | 5/2009 | Branch et al. |
| 8,955,543 | B2 | 2/2015 | Groesbeck et al. |
| 9,085,967 | B2 | 7/2015 | Bennett |
| 9,206,674 | B2 | 12/2015 | Luke |
| 9,291,007 | B2 | 3/2016 | Darbe et al. |
| 9,835,008 | B2 | 12/2017 | Rogers et al. |
| 10,378,296 | B2 | 8/2019 | Downey et al. |
| 10,435,984 | B2 | 10/2019 | Mericas et al. |
| 10,753,175 | B2 | 8/2020 | Stone |
| 10,760,355 | B2 | 9/2020 | Farley |
| 10,774,613 | B2 | 9/2020 | Gaspard et al. |
| 11,066,909 | B2 * | 7/2021 | Yin ..... E21B 34/103 |
| 11,242,719 | B2 | 2/2022 | Montoya et al. |
| 11,473,395 | B2 | 10/2022 | Yeldell et al. |
| 11,946,335 | B2 | 4/2024 | Sims et al. |
| 12,012,812 | B2 | 6/2024 | Arsoski et al. |
| 2003/0098163 | A1 | 5/2003 | Hebert et al. |
| 2004/0112644 | A1 | 6/2004 | Chan et al. |
| 2006/0278286 | A1 | 12/2006 | Spakowski et al. |
| 2010/0300566 | A1 | 12/2010 | Roberts et al. |
| 2013/0233548 | A1 | 9/2013 | Santeler et al. |
| 2017/0167225 | A1 | 6/2017 | Mericas et al. |
| 2020/0040702 | A1 | 2/2020 | Stone |
| 2020/0386074 | A1 | 12/2020 | Morrison |
| 2021/0222516 | A1 | 7/2021 | Montoya et al. |
| 2022/0154553 | A1 | 5/2022 | Giroux |
| 2023/0069930 | A1 | 3/2023 | Arsoski et al. |
| 2023/0399899 | A1 | 12/2023 | Mackay et al. |
| 2024/0344425 | A1 | 10/2024 | Ridner |
| 2024/0410251 | A1 | 12/2024 | Gaspard |

* cited by examiner

CONVERTIBLE AUTOFILL FLOAT EQUIPMENT HAVING POPPET VALVE AND INTERLOCK

CROSS-REFERENCE TO RELATED APPLICATIONS

This application claims the benefit of U.S. Provisional Appl. No. 63/767,362 filed Mar. 5, 2025, which is incorporated herein by reference in its entirety.

BACKGROUND OF THE DISCLOSURE

After a wellbore is drilled in a formation, the wellbore can be lined with a tubular, such as a casing string or a liner. As the casing string is run into the wellbore, the casing string is typically filled with a fluid, such as drilling mud. As is common, a float assembly, such as a float shoe or a float collar, is placed at or near the bottom of the casing string. The float assembly has one or more unidirectional float valves that allow fluid flow to pass out from the casing string into the annulus but prevent fluid flow from the annulus back into the casing string.

While running the casing string into the wellbore, the wellbore fluid can be used to sustain a portion of the weight of the casing string by floating the casing string in the wellbore fluid. The float assembly prevents fluid flow into the bottom of the casing string, allowing the casing string to float in the fluid present in the wellbore. Once the casing string is in position in the wellbore, a cementing operation is performed to fill the annulus between the casing string and the wellbore with cement, which can prevent the casing string from moving within the wellbore once set. During the cementing operation, the one or more float valves allow flow of fluids, such as spacer fluid, cement, displacement fluid and the like, pumped down the casing string to pass through the unidirectional float valves and pass into the wellbore annulus. The float valves keep these fluids from flowing from the annulus back into the casing string. In the end, the combination of the cement and the casing string strengthens the wellbore and isolates certain areas of the formation behind the casing for the production of hydrocarbons.

For a typical example, FIG. 1A illustrates a float collar 50A according to the prior art. The float collar 50A includes a tubular housing 52 accommodating a fill valve 60 therein. The fill valve 60 has a valve member that is generally mushroom shaped with a head biased upwardly against a valve seat by a spring circumjacent a stem of the valve member. A base in the seat supports the valve member and the spring.

The interior 54 of the housing 52 has an annulus filled with high density cement C therein. The cement C supports the fill valve 60, and the cement C has a passage communicating with the fill valve 60. During use, fluids including mud, conditioning fluid, and cement can flow through the passage and through the valve 60, but fluid from the wellbore is not permitted to pass uphole through the valve 60. The float collar 50A can be mounted with its box end 58 at the bottom of a casing string (not shown). The pin end 56 can attach to another extent of casing. Alternatively, a shoe (not shown) with box thread can thread to the pin end 56 of the float collar 50A to form a float shoe, or the float collar 50A may have a shoe integrally formed on the downhole end of the float collar 50A.

In some instances, a casing string may be deployed in a wellbore without floating the casing string. In this case, the unidirectional float valves are a hinderance to running in the casing string. Instead, a bidirectional valve is needed, allowing fluid flow to pass up into the casing string. During run in, for example, a convertible valve acts as a bidirectional valve, and the convertible valve is then converted to a unidirectional valve, operating like a typical float valve, once positioned downhole.

As can be seen, the conversion of the convertible valve allows fluid flow upwards during run in but prevents flow back into the casing string during later pumping operations. Convertible valves, or auto-fill valves, are known in the industry. A convertible valve of the prior art typically relies on a flapper valve, which is maintained in an open position during run in to allow automatic filling of the casing string. The convertible valve is then converted to a unidirectional valve by releasing the flapper from the open position so the flapper can then be biased towards the closed position.

For example, FIG. 1B shows a float collar 50B as disclosed in U.S. Pat. No. 10,208,567 having a convertible valve arrangement of the prior art. The float collar 50B has a tubular housing 52 attached to a tubular string 15. A valve assembly positioned within the tubular housing 52 includes flapper seats 62, flapper valves 64, a tubular element 70, and ball plug 76. The flapper seats 62 are attached to the interior of the tubular housing 52, and the flapper valves 64 are hingedly attached to the flapper seats 62 and are movable between opened and closed positions. The tubular element 70 is releasably connected by a shear pin 71 or one of the flapper seats 62. The tubular element 70 holds the flapper valves 64 in the opened position. The tubular element 70 has a downstream seat 72 and an upstream seat 74, which keep the ball plug 76 in the tubular element 70. The ball plug 76 is movable between the upstream and downstream seats 72, 74.

U.S. Pat. No. 12,012,812 discloses another example of float equipment having a convertible valve assembly of the prior art. A flow-actuated valve includes a body, a poppet, a spring, and a shifter. The poppet is movable relative to the body between an open position and a closed position, and the spring biases the poppet toward the closed position. The shifter has a drogue and a detent engaged with a detent profile of the poppet and a locking receptacle of the body when in an auto-fill mode, thereby keeping the poppet in a partially open position. The valve is operable to shift to a float mode in response to a first flow rate moving the poppet toward the open position to disengage the detent from the locking receptacle and a second flow rate imparting a drag force on the drogue sufficient to disengage the detent from the detent profile. The second flow rate is different than the first flow rate.

US 2024/0410251 discloses yet another example of float equipment having a convertible valve assembly of the prior art. A convertible valve assembly includes a valve housing defining a throughbore and includes a valve assembly for controlling fluid flow through the throughbore. The valve assembly has an upper plunger valve with an upper valve element and has a lower plunger valve with a lower valve element. The upper valve element and the lower valve element are connected such that the valve elements move in unison. The valve assembly has an open position such that both the upper and lower valve elements allow fluid flow through the valve assembly. The valve assembly has a closed position such that both the upper and lower valve elements are positioned to prevent fluid flow through the valve assembly. A retainer assembly for maintaining the valve assembly in the open position can selectively release the valve assembly to the closed position such that the upper and lower valves are biased toward the closed position.

Although existing float equipment may be useful, operators may require different configurations to improve functioning downhole. Accordingly, the subject matter of the present disclosure is directed to overcoming, or at least reducing the effects of, one or more of the problems set forth above.

SUMMARY OF THE DISCLOSURE

A float assembly disclosed herein is used on a tubing string having a throughbore for fluid flow. The float assembly comprises a housing, a valve, and an interlock. The housing is configured to couple to the tubing string. The housing defines a flow passage therein, which communicates with the throughbore of the tubing string. The flow passage has a seat.

The valve comprises a support, a primary biasing element, and a poppet. The support is disposed in the flow passage, and the primary biasing element is disposed on the support. The poppet is movably disposed on the support and is biased by the primary biasing element from an opened position to a closed position relative to the seat. The poppet in the opened position is disengaged from the seat and is configured to permit fluid flow through the flow passage. Meanwhile, the poppet in the closed position is engaged with the seat and is configured to prevent fluid flow in an upbore direction through the flow passage.

The interlock is arranged relative to the poppet and the support and has a surface area and a secondary biasing element. The surface area is exposed to fluid flow in the flow passage. The interlock is activatable from a locked state to an unlocked state in response to a level of fluid flow in a downbore direction against the surface area. The interlock in the locked state is configured to hold the poppet in the opened position. The secondary biasing element is disposed between the support and the interlock and biases the interlock to the locked state. The interlock in the unlocked state is configured to release the poppet biased toward the closed position by the primary biasing element.

In one configuration, the poppet defines at least one slot, and the interlock comprises a sleeve and at least one dog. The sleeve is disposed on the support and is movable at least from the locked state to the unlocked state. The secondary biasing element is engaged between the sleeve and the support and biasing the sleeve to the locked state. The at least one dog is disposed between the sleeve and the poppet and is movable relative to the at least one slot in response to the sleeve in the locked state and the unlocked state.

In another configuration, the interlock comprises a sleeve and a collet. The sleeve is disposed on the support and is movable at least from the locked state to the unlocked state. The secondary biasing element is engaged between the sleeve and the support and biases the sleeve to the locked state. The collet and a slot are arranged between the sleeve and the poppet. The collet is disengaged from the slot in response to the sleeve in the unlocked state.

In yet another configuration, the interlock comprises an inner sleeve and an outer sleeve. The inner sleeve is disposed on the poppet and is connected by a releasable connection to the poppet. The outer sleeve is disposed on the inner sleeve and is movable at least from the locked state to the unlocked state. The secondary biasing element is engaged between the outer sleeve and the support and biases the outer sleeve to the locked state. The outer sleeve moved to the unlocked state is configured to urge the inner sleeve and the releasable connection to release from one another.

In another configuration, the poppet defines at least one slot, and the interlock comprises a sleeve and at least one dog. The sleeve is arranged relative to the poppet and the support and has the surface area exposed to fluid flow in the flow passage. The sleeve is movable at least from a contracted position for the locked state to an extended position for the unlocked state in response to the level of fluid flow in the downbore direction acting against the surface area of the sleeve. The sleeve is biased to the contracted position by the secondary biasing element disposed between the support and the sleeve. The at least one dog is disposed between the sleeve and the poppet and is movable relative to the at least one slot in response to the sleeve in the contracted position to the extended position. The at least one dog with the sleeve in the contracted position is engaged with the slot of the poppet in the opened position. The at least one dog with the sleeve in the extended position is configured to disengage from the at least one slot of the poppet.

In yet another configuration, the interlock comprises an inner sleeve and an outer sleeve. The inner sleeve is arranged relative to the poppet and the support, and the inner sleeve is connected by a releasable connection to the poppet. The outer sleeve is arranged relative to the poppet and the support. The outer sleeve is disposed on the inner sleeve and has the surface area exposed to fluid flow in the flow passage. The outer sleeve is movable at least from a contracted position for the locked state to an extended position for the unlocked state in response to the level of fluid flow in the downbore direction acting against the surface area of the outer sleeve. The outer sleeve is biased to the contracted position by the secondary biasing element disposed between the support and the outer sleeve. The outer sleeve moved to the extended position is configured to urge the inner sleeve to release from the releasable connection.

In a further configuration, the poppet defines a slot, and the interlock comprises a sleeve and a collet. The sleeve is arranged relative to the poppet and the support and has the surface area exposed to fluid flow in the flow passage. The sleeve is movable at least from a first position for the locked state to a second position for the unlocked state in response to the level of fluid flow in the downbore direction acting against the surface area of the sleeve. The sleeve is biased to the second position by the secondary biasing element disposed between the support and the sleeve. The collet is arranged between the sleeve and the poppet. The collet is movable relative to the slot in response to the sleeve moved from the first position to the second position. The collet with the sleeve in the first position is engaged with the slot of the poppet in the closed position, and the collet with the sleeve in the second position is disengaged from the slot of the poppet.

In a further configuration, the poppet comprises a collet, and the interlock comprises an inner sleeve and an outer sleeve. The inner sleeve is arranged relative to the poppet and the support and has a wedged slot. The wedged slot is configured to releasably engage the collet of the poppet in the opened position. The outer sleeve is arranged relative to the poppet and the support. The outer sleeve is disposed on the inner sleeve and has the surface area exposed to fluid flow in the flow passage. The outer sleeve is movable from a retracted position for the locked state of the interlock to an extended position for the unlocked state of the interlock in response to the level of fluid flow in the downbore direction acting against the surface area of the outer sleeve. The outer sleeve is biased to the retracted position by the secondary biasing element disposed between the support and the outer sleeve. The outer sleeve moved to the extended position is configured to urge the inner sleeve to release the collet on the poppet from the wedged slot on the inner sleeve.

A method disclosed herein is used for a tubing string in a wellbore. The tubing string has a throughbore for fluid flow. The method comprises: deploying the tubing string in the wellbore while allowing fluid flow in an upbore direction and a downbore direction though a poppet valve biased with a primary biasing element by holding the biased poppet valve in a bidirectional state with an interlock biased by a secondary biasing element to a locked state; and restricting fluid flow to only the downbore direction through the throughbore by: pumping fluid flow in the downbore direction at a predetermined level against a surface area of the interlock; releasing the interlock from the locked state to an unlocked state in response to the fluid flow at the predetermined level acting against the surface area of the interlock; disengaging the biased poppet valve from the interlock in the unlocked state; and allowing fluid flow only in the downbore direction though the biased poppet valve disengaged from the interlock.

The foregoing summary is not intended to summarize each potential configuration or every aspect of the present disclosure.

DETAILED DESCRIPTION OF THE DISCLOSURE

Figure 1A:
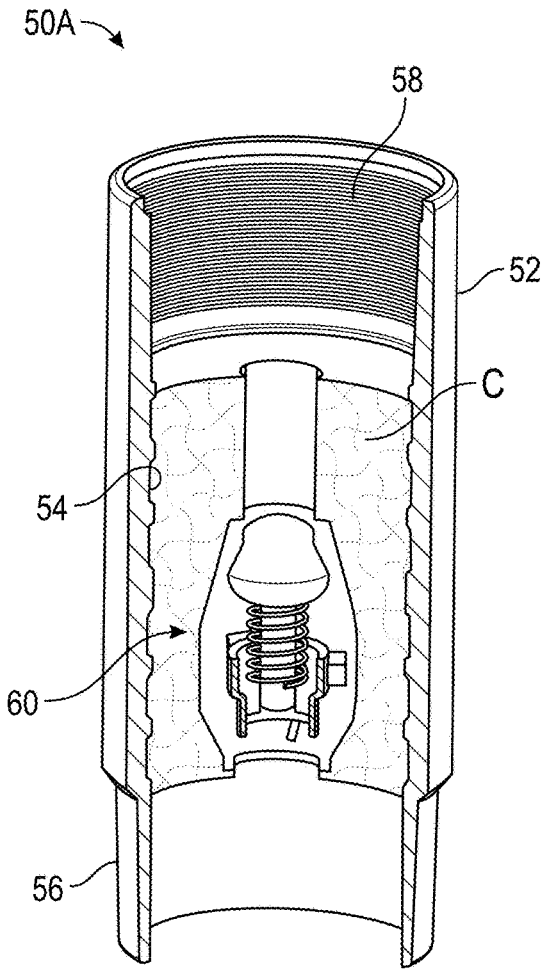
FIG. 1A (Prior Art)
FIG. 1A illustrates a float assembly according to the prior art.
Figure 1B:
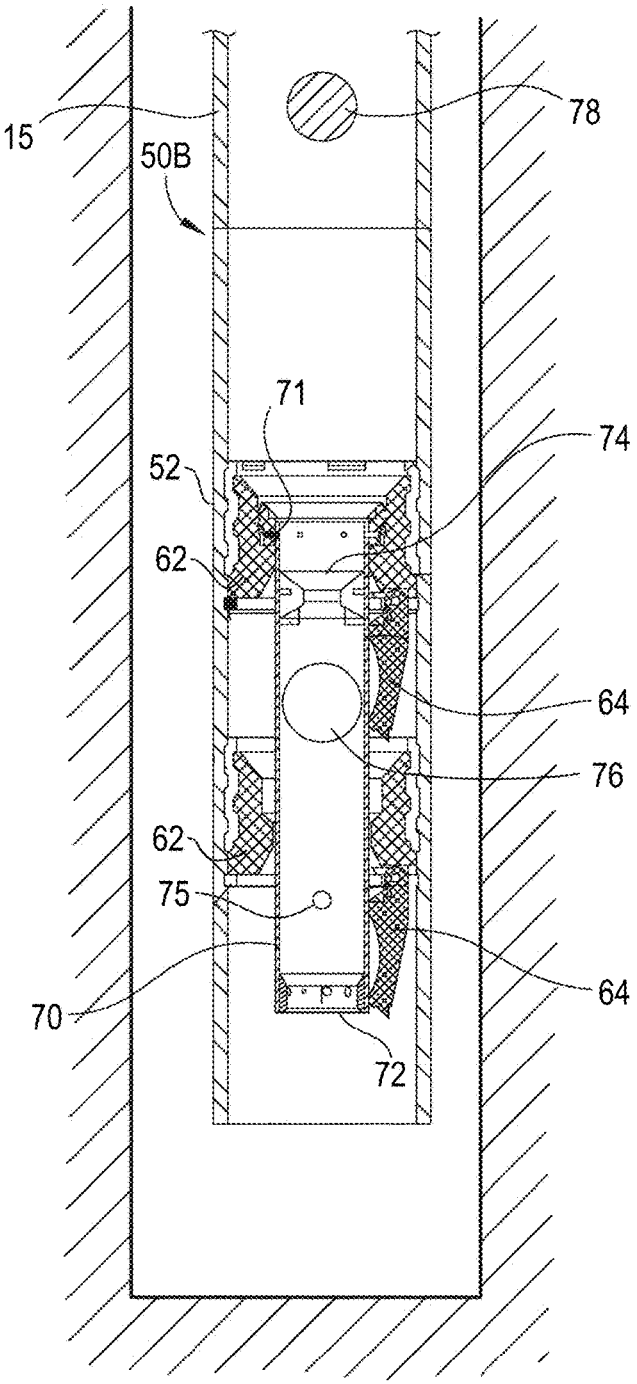
FIG. 1B (Prior Art)
FIG. 1B illustrates another float assembly having a convertible valve assembly according to the prior art.
Figure 2:
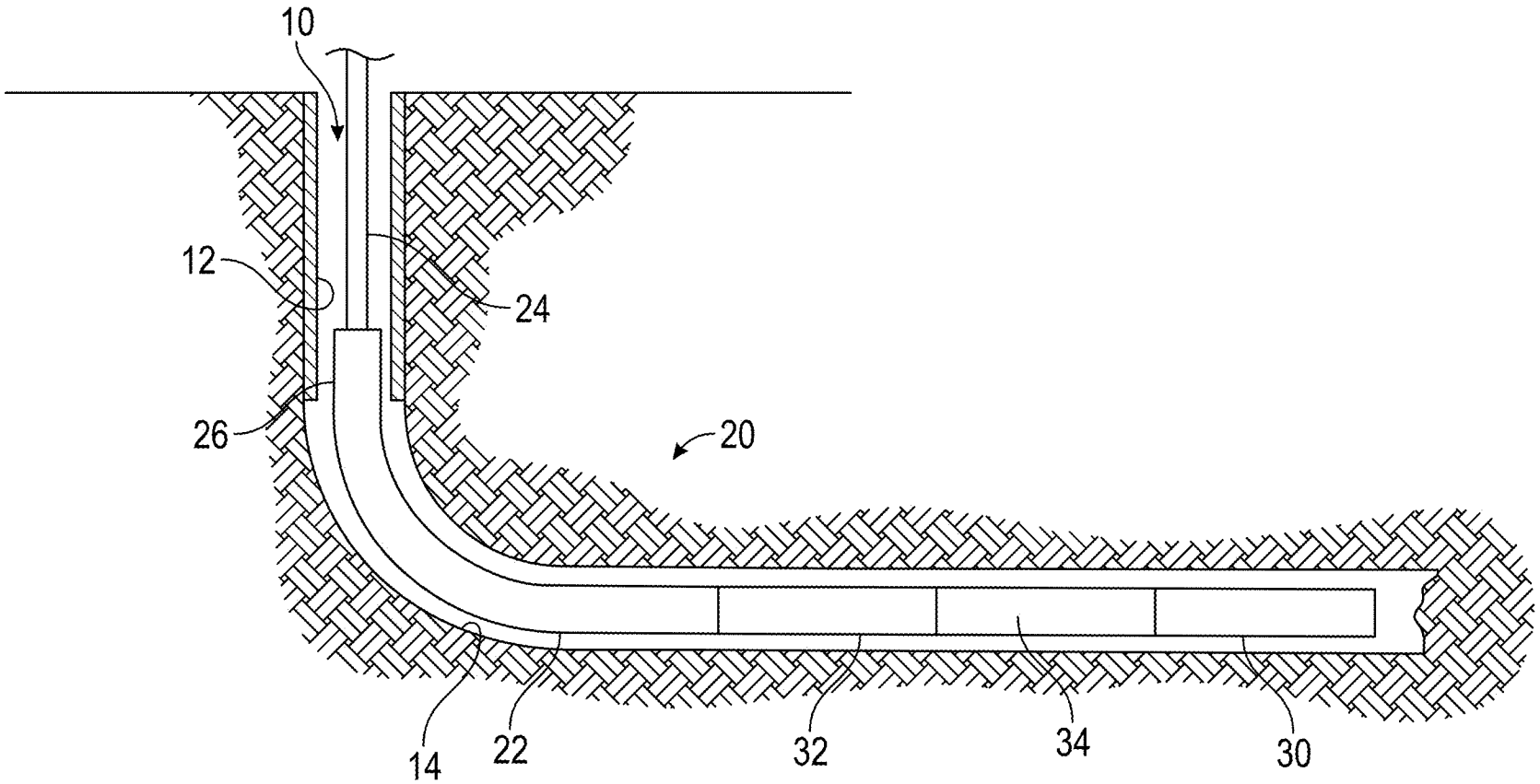
FIG. 2 illustrates a liner system having a liner disposed in a borehole and having one or more autofill float assemblies according to the present disclosure.

FIG. 2 illustrates a liner system 20 being lowered into a wellbore 10 on a work string 24. The wellbore 10 may have a cased portion 12 and an open hole portion 14 and may or may not have a horizontal section. A liner hanger 26 is supported by the work string 24 and is operable to secure a tubing string 22 (e.g., casing string or liner) in the wellbore 10. The work string 24 and the liner hanger 26 may include and/or be operable with any conventional running tools known in the art for securing liner hangers in wells.

The liner 22 can have one or more float assemblies 30, 32 having an autofill configuration and allowing fluids to enter and exit the liner 22 while the liner 22 is deployed into the wellbore 10. During run-in of the liner 22, for example, the wellbore 10 can be damaged by surge pressure arising from displaced wellbore fluid exerting pressure on the wellbore 10. To help alleviate surge pressure, the one or more float assemblies 30, 32 are designed to permit wellbore fluids to flow into the liner 22 while the liner 22 is lowered into the wellbore 10. As a result, wellbore fluids can be displaced into the liner 22 as it is lowered, which reduces surge pressure. In this way, the one or more float assemblies 30, 32 can allow the liner 22 to be run into the wellbore 10 at a more efficient speed without damaging the wellbore 10.

Although the one or more float assemblies 30, 32 are designed for bidirectional operation to permit wellbore fluids to flow into the liner 22 during run-in, the one or more float assemblies 30, 32 are also convertible to uni-directional operation to permit only one-way flow of fluid to flow out of the liner 22 for the cementing operation. During this cementing operation, for example, displacement fluid, spacers fluid, cement slurry, and the like is pumped downhole through the liner 22 and into the annular area between the liner 22 and the wellbore 10. During this operation, the one or more float assemblies 30, 32 act as a one-way check valve permitting cement slurry to be expelled from the liner 22 while subsequently preventing the cement slurry from reverse flowing (also referred to as a U-tubing) back into the liner 22.

Without the uni-directional operation at the downhole end of the liner 22, the cement slurry may reverse flow into the liner 22 if the hydrostatic pressure within the wellbore annulus exceeds the hydrostatic pressure within the liner 22. For example, after the cement slurry is expelled from the liner 22, hydrostatic pressure within the liner 22 is sometimes relieved or reduced. Hydrostatic pressure within the wellbore annulus may then exceed the hydrostatic pressure within the liner 22. In this situation, the one or more float assemblies 30, 32 must act as a check-valve to prevent reverse flow.

For the one or more float assemblies 30, 32 to permit wellbore fluids to flow into the liner 22 during run-in, the one or more float assemblies 30, 32 include a convertible valve assembly, as disclosed below. Such a convertible valve assembly initially permits wellbore fluid to enter into the liner 22 during run-in to alleviate surge pressure within the wellbore. The convertible valve assembly is then converted to a one-way check valve to prevent cement slurry from reverse flowing from the annular area back into the liner 22.

In one configuration, for example, one float assembly 30 can be part of a float shoe on the liner system 20. During run-in, the float assembly 30 can have an autofill configuration, allowing fluids to enter and exit the liner 22 while the liner 22 is lowered into the wellbore 10 to alleviate surge pressure within the wellbore 10. During cementation, the float assembly 30 can then be converted to operate as a one-way valve to prevent cement from reverse flowing back into the liner 22 after placement.

In such a configuration, another float assembly 32 can also be used and can be part of a float collar on the liner system 20. As part of a float collar, the float assembly 32 may be placed one or more joints above a guide shoe or a float shoe. This other float assembly 32 can also have an autofill configuration, allowing fluids to enter and exit the liner 22 while the liner 22 is lowered into the wellbore 10 to alleviate surge pressure within the wellbore 10. Then, for cementing, the other float assembly 32 can be converted to a one-way valve to prevent reverse flow into the liner 22.

Additionally, this other float assembly 32 can provide a seat for cement plugs during a cement operation. The space 34 between the float assemblies (i.e., float shoe 30 and the float collar 32) can be used to entrap the contaminated fluids left from the wiping action of a top cementing plug during the cement operation. This space 34 can keep the contaminated fluid away from the float shoe 30 where a strong cement bond is needed.

In another arrangement, the space 34 between the float assemblies 32, 30 can initially be filled with a material having a density less than the density of the fluids in the wellbore 10. For example, the space 34 may hold air, nitrogen, light weight liquids or solids, foam, polystyrene, plastic, rubber, or combinations thereof. For run-in, the space 34 of lower density can make the liner 22 buoyant as the liner 22 is moved through the fluids in the wellbore 10, which can reduce drag forces created by contact with the surfaces of the wellbore 10. The float assemblies 30, 32 can be initially configured for autofill to allow fluid communication into and out of the liner 22 should surge pressure within the wellbore 10 needs to be alleviated while the liner 22 is lowered into the wellbore 10. Then, to perform cementing, the float assemblies 30, 32 can be converted to a one-way valve to contain backpressure and prevent cement from flowing back into the liner 22 after placement.

Figure 3A:
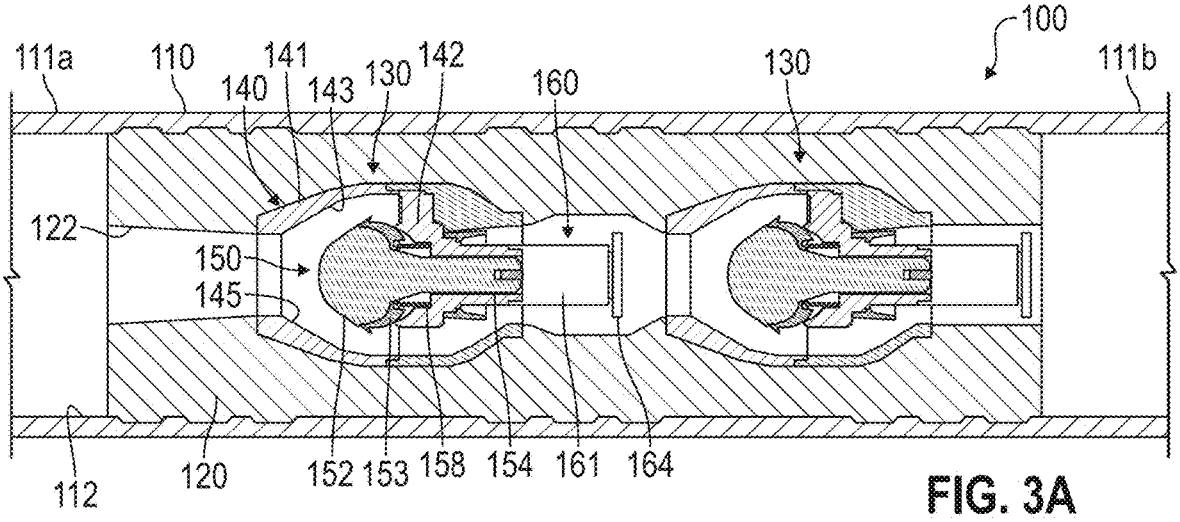
FIG. 3A illustrates an autofill float assembly having poppet valves and release mechanisms of the present disclosure in a run-in condition.
Figure 3B:
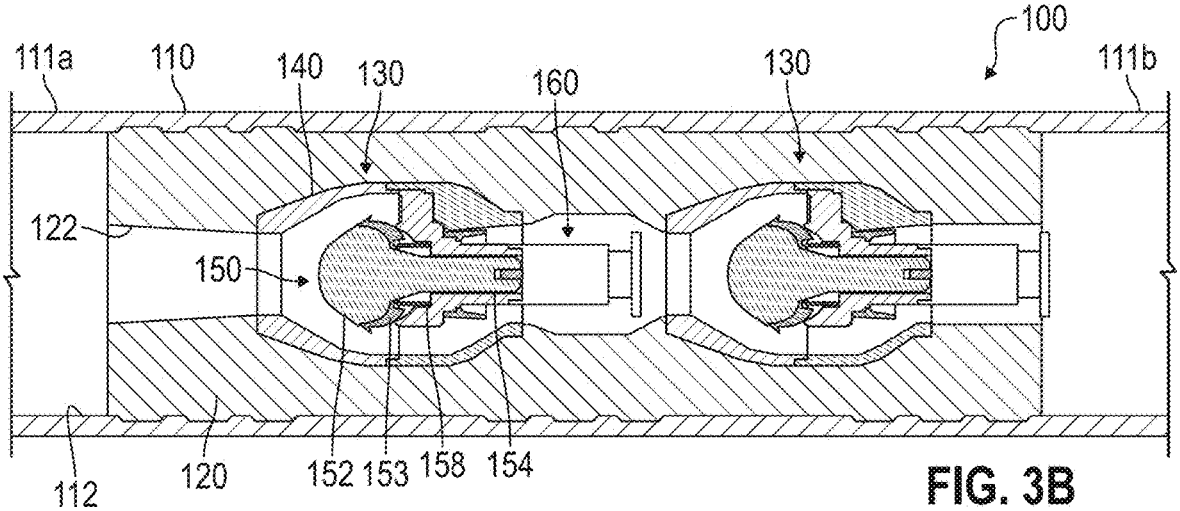
FIG. 3B illustrates the autofill float assembly of FIG. 3A in a release condition.
Figure 3C:
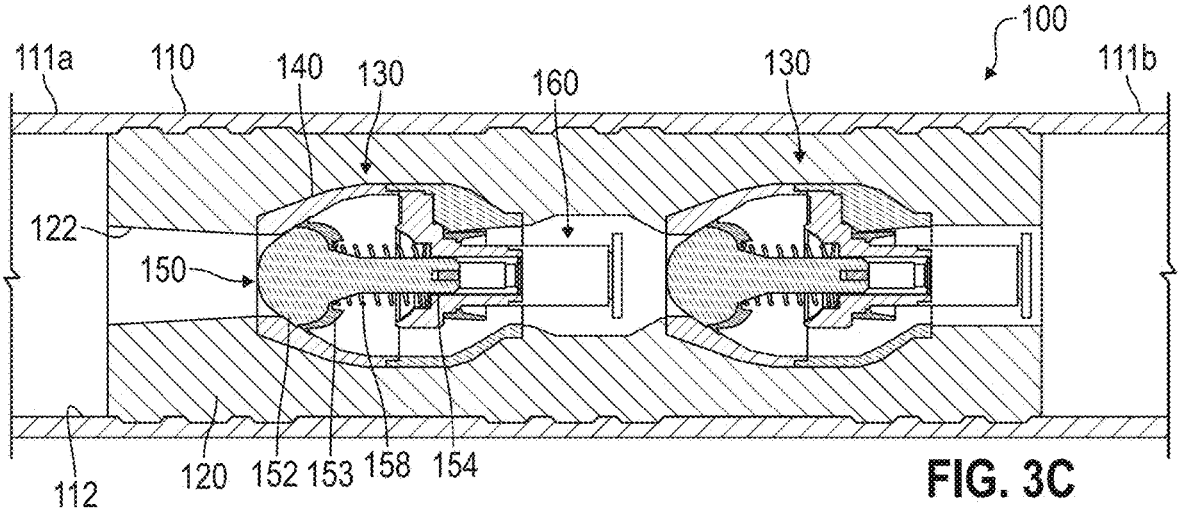
FIG. 3C illustrates the autofill float assembly of FIG. 3A in a converted condition.

FIGS. 3A-3C illustrate cross-sections of an autofill float assembly 100 according to the present disclosure, which can be used on a liner as discussed above or can be used on another tubing string. The autofill float assembly 100 solves issues associated with float equipment having flapper valves when used to alleviate surge pressure during deployment (run-in) of a tubular string. As shown, the autofill float assembly 100 uses poppet valves 130, which are maintained independent of one another. A release mechanism, fixture, or interlock 160 is independently installed on each poppet valve 130. During use, the interlock 160 is activated by an increased flow rate acting on the surface area (e.g., flow element, disc, plate, etc.) of the interlock 160.

As shown in FIGS. 3A-3B, the autofill float assembly 100 includes a housing or body 110 and a poppet valve 130. Two poppet valves 130 are shown, but other configurations of the autofill float assembly 100 may have one poppet valve 130 or more than two poppet valves 130 of the present disclosure. The housing 110 is configured to couple to the tubing string (not shown), and the housing 110 defines a bore 112 therein communicating with the throughbore of the tubing string. As will be appreciated, the housing 110 can be a tubular having appropriate box and/or pins on the ends 111*a-b* for coupling to tubing or other downhole tools on the tubing string.

Each poppet valve 130 includes a support 140 and a poppet 150. In general, the support 140 is disposed in the bore 112 of the housing 110. As shown, the housing 110 can have a filler material 120, such as cement or the like, disposed in the bore 112 of the housing 110 to hold the support 140 in the housing 110. The filler material 120 defines a flow passage 122 communicating with the bore 112.

For its part, the support 140 as shown has an insert 141 defining a chamber 143, which has a seat 145 and communicates with the flow passage 122. A base or support ledge 142 of the support 140 is disposed in the chamber 143 and has the poppet 150 disposed thereon. As further shown, the poppet 150 includes a head 152, a seal 153, and a stem 154, and a biasing element 158. The poppet 150 is biased by the biasing element 158 toward the seat 145. For example, the biasing element can be a spring engaged between the support ledge 142 and the poppet's head 152.

The poppet 150 is movably disposed on the support ledge 142 and is biased by the spring 158 from an opened position (in which the head 152 is distanced from the seat 145) to a closed position (in which the head 152 is engaged against the seat 145).

The release mechanism, fixture, or interlock 160 is arranged relative to the poppet 150 and the support 140. The interlock 160 is activatable from a first (initial or locked) state to a second (subsequent or unlocked) state in response to a level of fluid flow in the downbore direction. In the locked state, the interlock 160 is engaged with the poppet 150 while the poppet 150 is in the opened position. As such, the interlock 160 can hold the poppet 150 open, which permits fluid flow through the flow passage 122 (as well as the bore 112 and the chamber 143) in both the downbore and upbore direction. In the unlocked state, however, the interlock 160 is disengaged from the poppet 150, allowing the poppet 150 to close. When the interlock 160 is disengaged from the poppet 150, for example, the poppet 150 can be biased by the spring 158 to the closed position based on the pressure differential across the poppet 150. Therefore, depending of the pressure differential, the poppet 150 can permit fluid flow through the flow passage 122 (as well as the bore 112 and the chamber 143) in the downbore direction, but can restrict fluid flow in the upbore direction.

As shown in FIG. 3A, the interlock 160 generally includes a body 161 disposed on the support 140. The body 161 has a surface area 164 exposed to fluid flow in the flow passage. As discussed in more detail below, the body 161 can include a sleeve, a biasing element, a dog, a collet, and the like, and the surface area 164 can be provided by a disc, a plate, a fin, or the like.

At least a portion of the body 161 is movable from a contracted position to an extended position in response to the level of fluid flow in the downbore direction acting against the surface area 164 of the body 161. With the body 161 in the contracted position, the interlock 160 can be engaged in the locked state with the poppet 150, holding the poppet 150 open. With the body 161 in the extended position, the interlock 160 can be disengaged in the unlocked state from the poppet 150, allowing the poppet 150 to open and close.

An internal bias (not shown) between the support 140 and the body 161 can bias the body 161 to the contracted position so the fluid flow in the downbore direction may need to overcome this internal bias in order to convert the interlock from the locked state to the unlocked state. Additionally, an internal release mechanism between the support 140 and the body 161 can hold the body 161 in the contracted position, and the internal release mechanism may be released in response to a predetermined force from the downbore flow against the surface area 164.

FIG. 3A shows the autofill float assembly 100 in a run-in (autofill) condition. Flow can pass in both upbore and downbore directions through the poppet valves 130. In the run-in position of FIG. 3A, the interlocks 160, which may vary depending on the arrangement, lock their respective poppet 150 in the locked state to allow forward and reverse flow through the autofill float assembly 100, as desired according to the well operations.

When this autofill feature is no longer required, operators increase the flow rate from surface. The increased flow in turn acts on the interlocks 160, releasing its hold of the respective poppet 150 in its opened position. FIG. 3B shows the autofill float assembly 100 in a released condition with the interlocks 160 being activated to release the respective poppet 150. As noted, the interlock 160 is activated by increased flow that passed in the downbore direction against the surface area 164. When a sufficient force is produced by the downbore flow, the autofill float assembly 100 switches from the autofill flow state to a downbore-only flow state in which fluid can be channeled through the poppet valves 130 in a downbore-only direction.

Finally, FIG. 3C shows the autofill float assembly in the converted condition. The autofill float assembly 100 can now operate in a downbore-only flow state in which fluid can be channeled through the poppet valves 130 in a downbore-only direction. By default, the springs 158 bias the poppets 150 closed against the seats 145. Downbore flow of sufficient pressure can overcome the bias of the springs 158 to open the poppets 150 from the seats 145 so downbore fluid can flow out through the autofill float assembly 100. Any upbore flow will close the poppet 150 against the seat 145, preventing the upbore flow from passing up through the autofill float assembly 100.

Because the autofill float assembly 100 has independent interlocks 160, each poppet valve 130 can be activated on demand by increasing flow rate acting on the surface area 164 (or other flow-receiving device), which enables (or disables) the interlock 160. The double poppet valves 130 can operate independently and provide redundancy. Because the extended features of the interlock and disrupt flow and restrict flow downstream of the poppet valve 130, the flow passage 122 downstream of the poppet valve 130 may be increased.

A. Mechanical Release-Spring/Dogs

Figure 4:
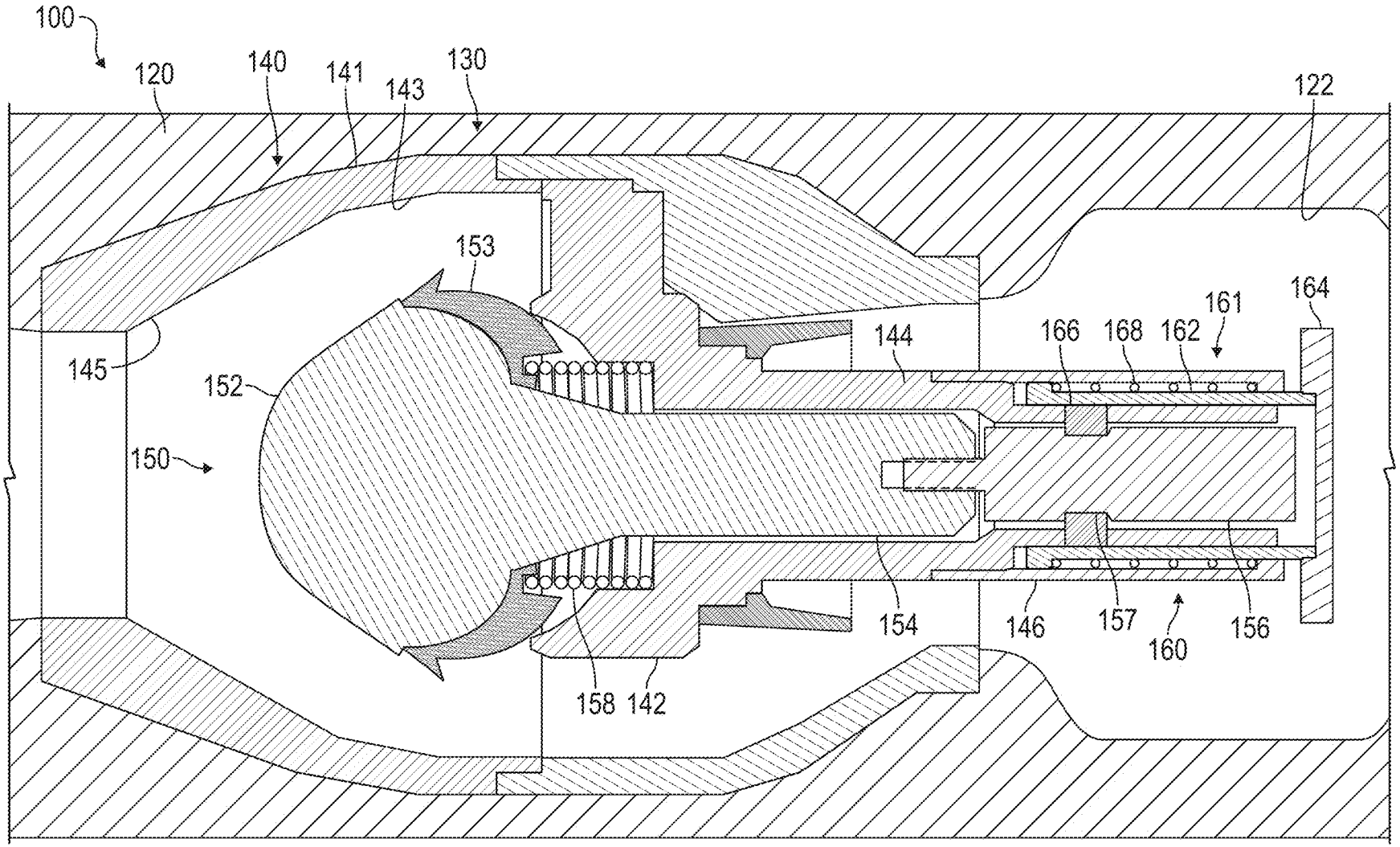
FIG. 4 illustrates portion of an autofill float assembly having a poppet valve and a first configuration of the release mechanism of the present disclosure.

In one arrangement, the release mechanism, fixture, or interlock 160 includes a dog system. For example, FIG. 4 illustrates a detailed view of an autofill float assembly 100 having a poppet valve 130 and a first configuration for the interlock 160 of the present disclosure. Similar features to those discussed previously have the same reference numerals. As shown, the poppet 150 defines at least one slot 157. For assembly purposes, a stem extension 156 can be affixed to a distal end of the poppet's stem 154, and the stem extension 156 can define the slot 157.

The body 161 includes a sleeve 162 disposed on the support 140. For assembly purposes, the sleeve 162 can be disposed on a lower rim 144 of the support ledge 142, which can house the poppet's stem extension 156. An outer cover 146 of the support 140 can be affixed to the support ledge 142 and can protect the sleeve 162. A biasing element 168, such as a spring, is disposed between the upper end of the sleeve 162 and a portion of the support 140, such as a lip of the cover 149 as shown. The body 161 includes one or more dogs 166 disposed between the sleeve 162 and the poppet 150 (i.e., the stem extension 156). The dogs 166 are movable relative to the slot 157 based on the position of the sleeve 162 in the contracted and extended positions.

Figure 5A:
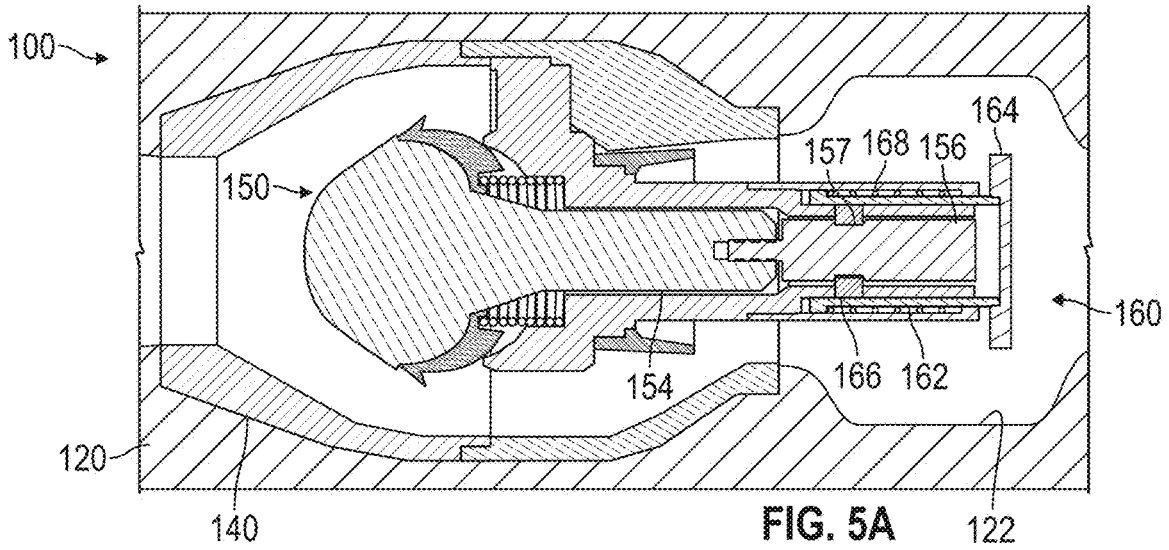
FIG. 5A illustrates the poppet valve of the autofill float assembly of FIG. 4 in a run-in condition.
Figure 5B:
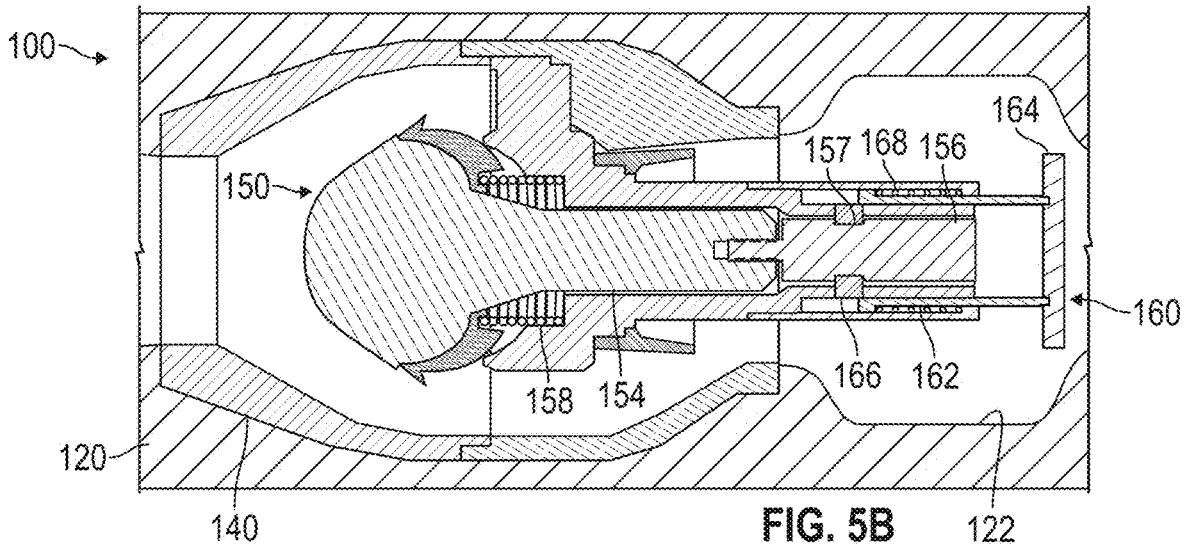
FIG. 5B illustrates the poppet valve of the autofill float assembly of FIG. 4 in a release condition.
Figure 5C:
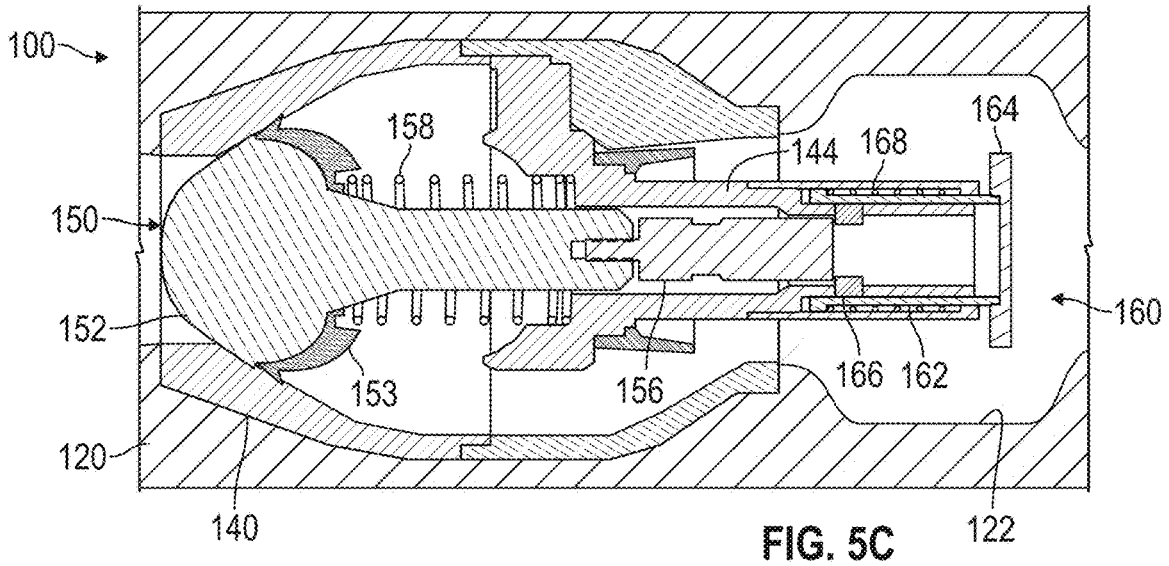
FIG. 5C illustrates the poppet valve of the autofill float assembly of FIG. 4 in a converted condition.

FIGS. 5A-5C illustrate the poppet valve 130 of the autofill float assembly 100 of FIG. 4 in a run-in condition, a release condition, and a converted condition. As shown in FIG. 5A, the autofill float assembly 100 in the run-in (autofill) condition allows flow to pass in both upbore and downbore directions. The dogs 166 engaged in the slot 157 of the poppet 150 (i.e., in the stem extension 156) keeps the poppet 150 in the open position.

Sufficient downbore flow acting against the surface area 164 moves the sleeve 162 against the bias of the spring 168 so that the sleeve 162 moves away from the dogs 166 as shown in FIG. 5B. The downbore flow on the poppet 150 can further compress the poppet 150 against its biasing element 158 so the stem extension 156 can push the exposed dogs 166 from the slot 157. The dogs 166 disengaged from the slot 157 then release the poppet 150. When the downbore flow is relieved as shown in FIG. 5C, the poppet 150 can be biased closed by the spring 158. The sleeve 162 of the interlock 160 can be shifted by its spring 168, but the dogs 166 no longer engage the poppet 150.

Because the extended features of the interlock and disrupt flow and restrict flow downstream of the poppet valve 130, the flow passage 122 downstream of the poppet valve 130 may be increased. Splines, tracks, guide pins, or other features can prevent the sleeve 162 from rotating. The sleeve 162 may be inactivated from moving again when downbore flow is experienced. Different configurations can be used to achieve this purpose. For example, the dogs 166 may become loose and may dislodge from the lower rim 144 so they would no longer engage the slot 157. In another example, a snap ring, lip and detent arrangement, ratchet arrangement, or the like (not shown) may fix the sleeve 162 in an inactive state on the support (i.e., lower rim 144) once the dogs 166 are released from the slot 157.

B. Mechanical Release-Spring/Shear Wire

Figure 6:
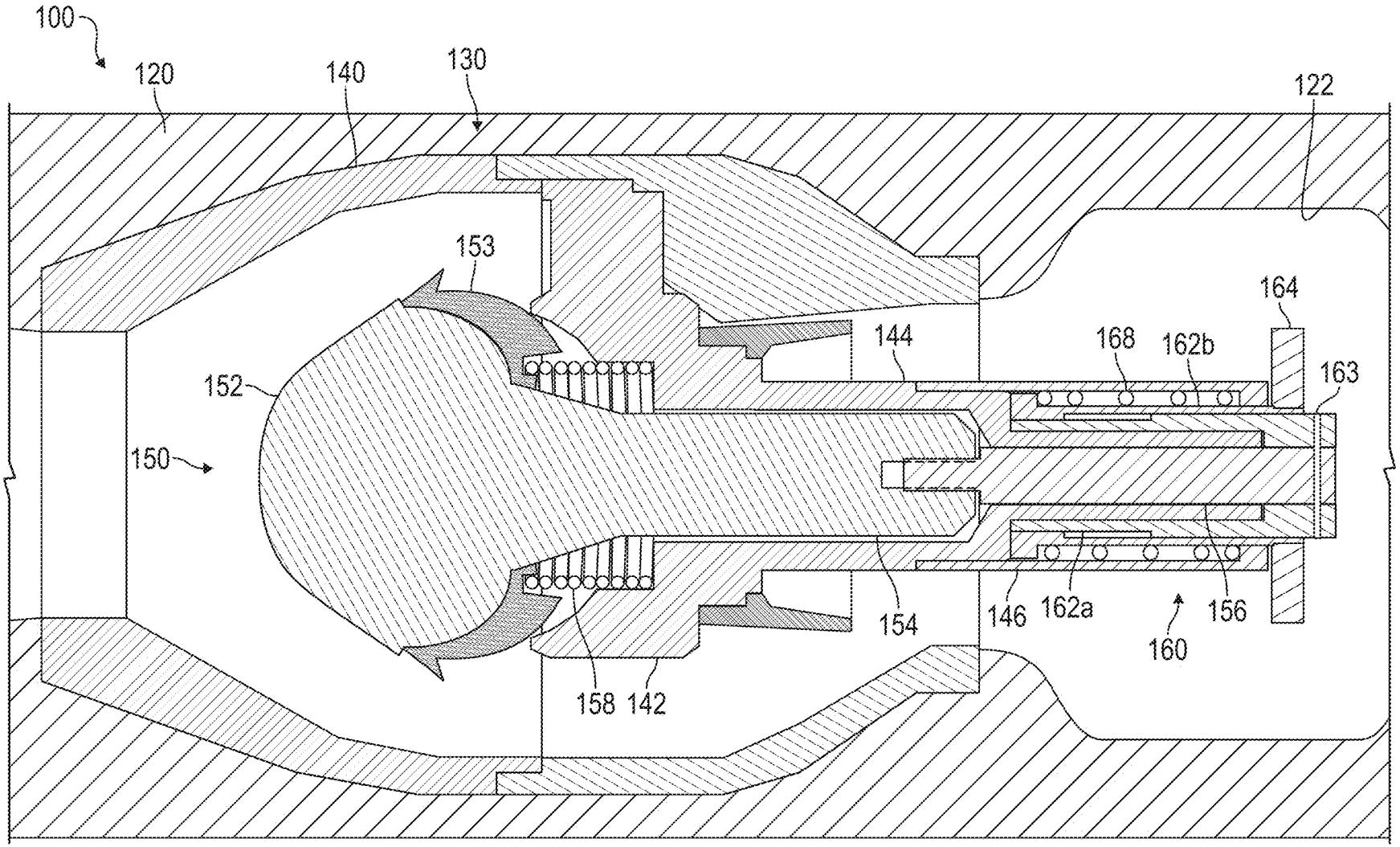
FIG. 6 illustrates portion of an autofill float assembly having a poppet valve and a second configuration of the release mechanism of the present disclosure.

In another arrangement, the release mechanism, fixture, or interlock 160 includes a shear wire system that enables the conversion. For example, FIG. 6 illustrates a detailed view of an autofill float assembly 100 having a poppet valve 130 with a second configuration for the interlock 160. Again, for assembly purposes, the poppet 150 can include the stem extension 156 extending from the stem 154 of the poppet 150, and the inner sleeve 162*a* can be disposed on a lower rim 144 of the support ledge 142, which can house the poppet's extension 156.

As shown, the body 161 includes an inner sleeve 162*a* disposed on the poppet 150 (i.e., on the stem extension 156) and connected by a releasable connection 163 thereto. The body 161 also includes an outer sleeve 162*b* disposed on the inner sleeve 162*a*. The outer sleeve 162*b* is biased to the contracted position by the biasing element 168, such as a spring, disposed between the support 140 and the outer sleeve 162*b*. For assembly purposes, an outer cover 146 of the support 140 can be affixed to the support ledge 142 and can protect the outer sleeve 162*b*. The spring 168 can be disposed between an upper end of the outer sleeve 162*b* and portion of the support 140, such as a lip of the cover 146 as shown. The outer sleeve 162*b* can have a disc, a plate, or another flow element affixed to its end to provide the surface area 164 for the fluid flow. The outer sleeve 162*b* moved to an extended position is configured to urge the inner sleeve 162*a* to release from the releasable connection 163. In general, the releasable connection 163 can be a shear pin or wire as shown, but other devices can be used.

Figure 7A:
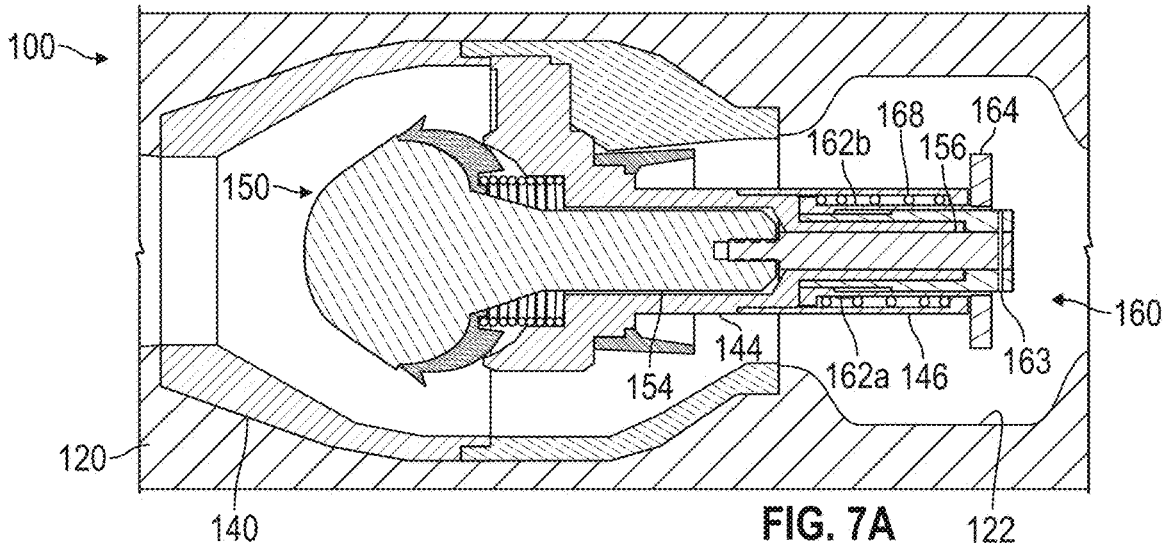
FIG. 7A illustrates the poppet valve of the autofill float assembly of FIG. 6 in a run-in condition.
Figure 7B:
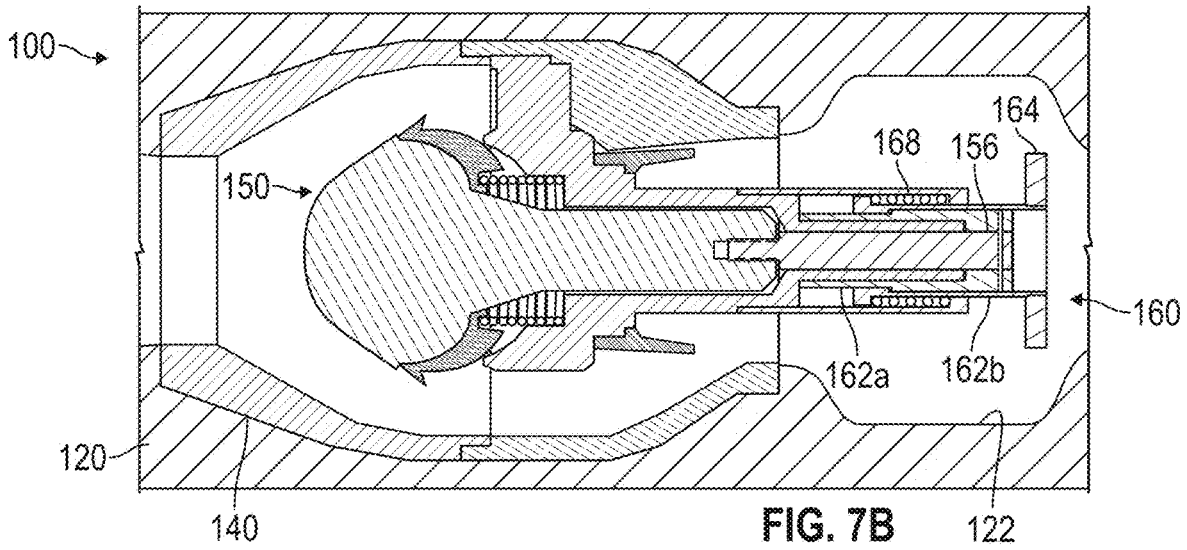
FIG. 7B illustrates the poppet valve of the autofill float assembly of FIG. 6 in a release condition.
Figure 7C:
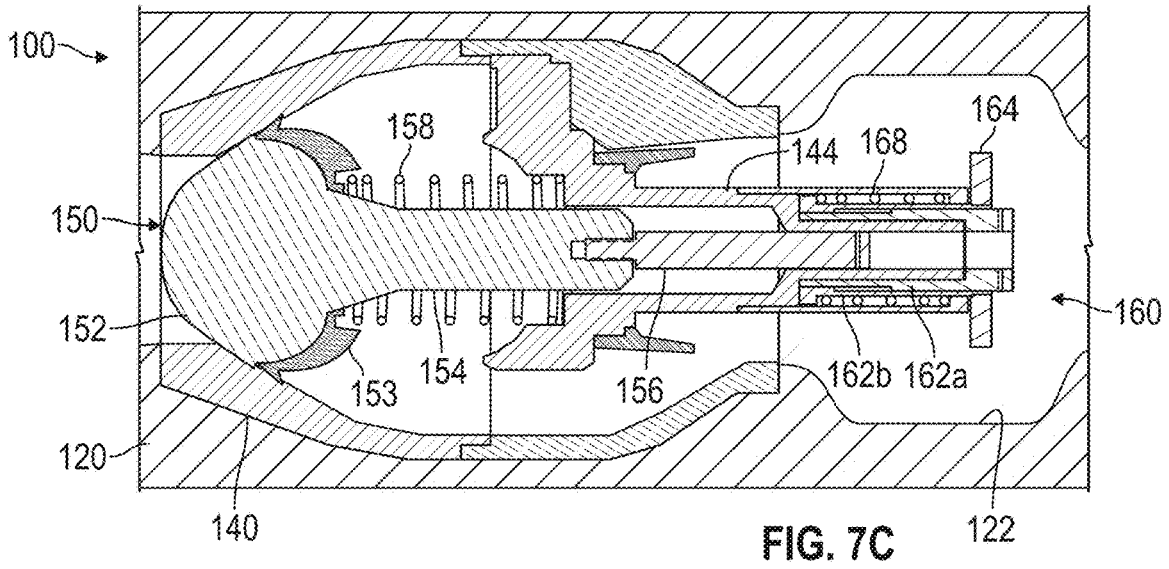
FIG. 7C illustrates the poppet valve of the autofill float assembly of FIG. 6 in a converted condition.

FIGS. 7A-7C illustrate the poppet valve 130 of the autofill float assembly of FIG. 6 in a run-in condition, a release condition, and a converted condition. As shown in FIG. 7A, the autofill float assembly 100 in the run-in (autofill) condition allows flow to pass in both upbore and downbore directions. The releasable connection 163 engaged between the inner sleeve 162*a* and the poppet 150 (i.e., the stem extension 156) keeps the poppet 150 in the open position.

Sufficient downbore flow acting against the surface area 164 moves the outer sleeve 162*b* against the bias of the spring 168 so that the outer sleeve 162*b* moves downbore as shown in FIG. 7B. The downbore movement of the outer sleeve 162*b* eventually moves the inner sleeve 162*a* so the releasable connection 163 is broken between the inner sleeve 162*a* and the poppet's stem extension 156. The poppet 150 is thereby released. When the downbore flow is relieved as shown in FIG. 7C, the poppet 150 can be biased closed by the spring 158. The outer sleeve 162*b* of the interlock 160 can be shifted by its spring 168, but the releasable connection 163 is no longer engaged with the poppet 150. The bias of the spring 158 can move the poppet 150 so that the releasable connection 163 also releases between the stem extension 156 and the inner sleeve 162*a*.

Because the extended features of the interlock and disrupt flow and restrict flow downstream of the poppet valve 130, the flow passage 122 downstream of the poppet valve 130 may be increased. Splines, tracks, or other features can prevent the outer sleeve 162*b* from rotating. The outer sleeve 162*b* may be inactivated from moving again when downbore flow is experienced. Different configurations can be used to achieve this purpose. For example, a snap ring, lip and detent arrangement, ratchet arrangement, or the like (not shown) may fix the outer sleeve 162*b* in an inactive state on the support (i.e., cover 146) once the releasable connection 163 is released. The top end of the outer sleeve 162*b* can engage a lip or a rim (not shown) on an edge of the inner sleeve 162*a* so the spring 168 and outer sleeve 162*b* can hold the inner sleeve 162*a* in position.

C. Mechanical Release-Spring/Collet

Figure 8:
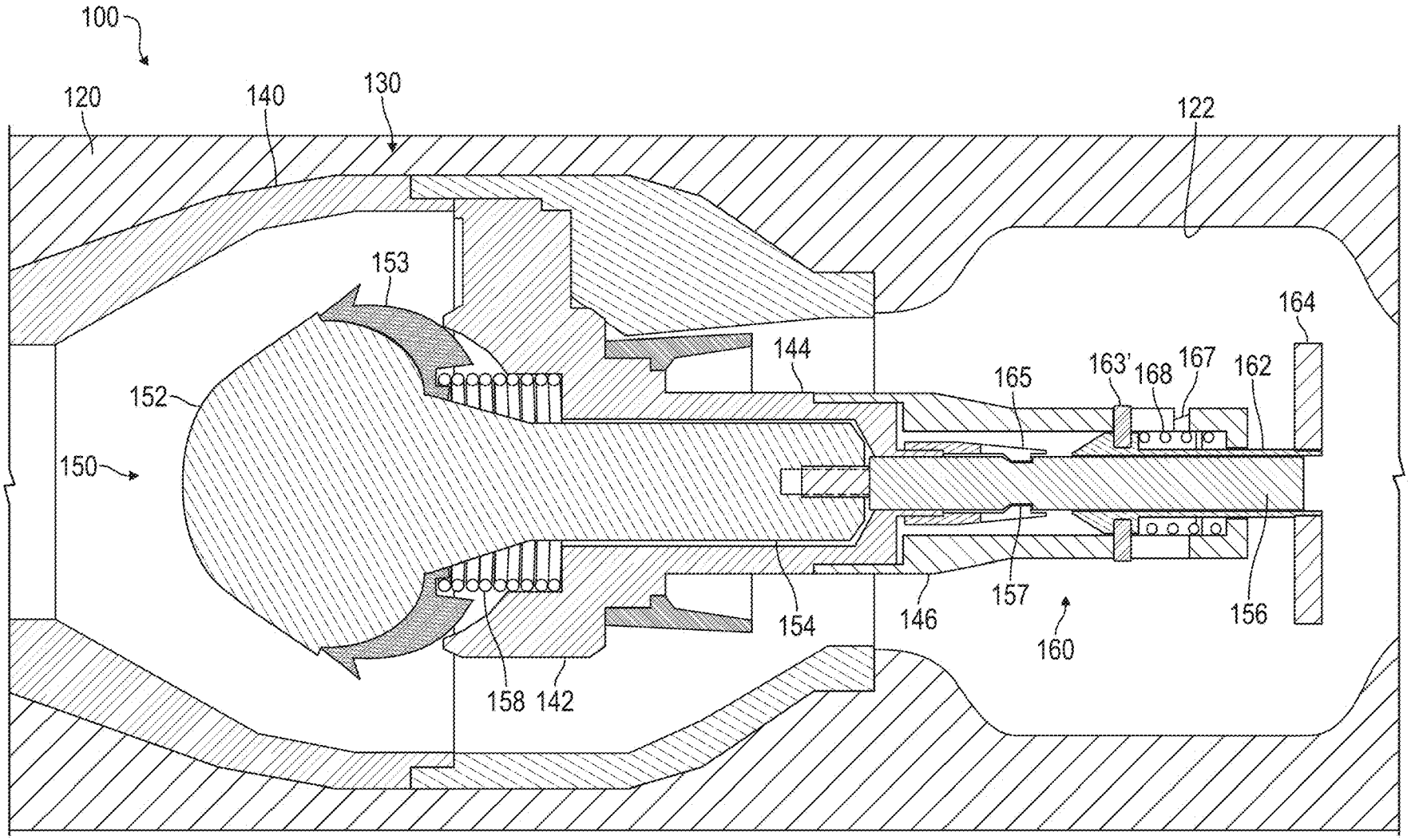
FIG. 8 illustrates portion of an autofill float assembly having a poppet valve and a third configuration of the release mechanism of the present disclosure.

In other arrangements, the release mechanism, fixture, or interlock 160 includes a collet system. For example, FIG. 8 illustrates a detailed view of an autofill float assembly 100 having a poppet valve 130 with a third configuration for the release mechanism, fixture, or interlock 160. As shown, the poppet 150 defines at least one slot 157. Again, for assembly purposes, a stem extension 156 can be affixed to the stem 154 of the poppet 150, and the stem extension 156 can define the slot 157.

The body 161 includes a sleeve 162 disposed on the poppet 150. The sleeve 162 has a disc, plate, or another flow element for the surface area 164 affixed to its end for the fluid flow. The sleeve 162 has guide pins 163' that can move within guide slots 167 on the support 140. For example, the guide slots 167 can be J-slots defined in a cover 146 affixed to the rim 144 on the support ledge 142. The biasing element 168, such as a spring, is engaged between the sleeve 162 and the support 140 (i.e., rim of the cover 146). The guide pins 163 can move in the guide slots 167 so that the sleeve 162 can rotate. The interlock 160 includes a collet 165 disposed between the support 140 and the poppet 150. Fingers of the collet 165 are movable relative to the slot 157 in response to movement of the sleeve 162.

Figure 9A:
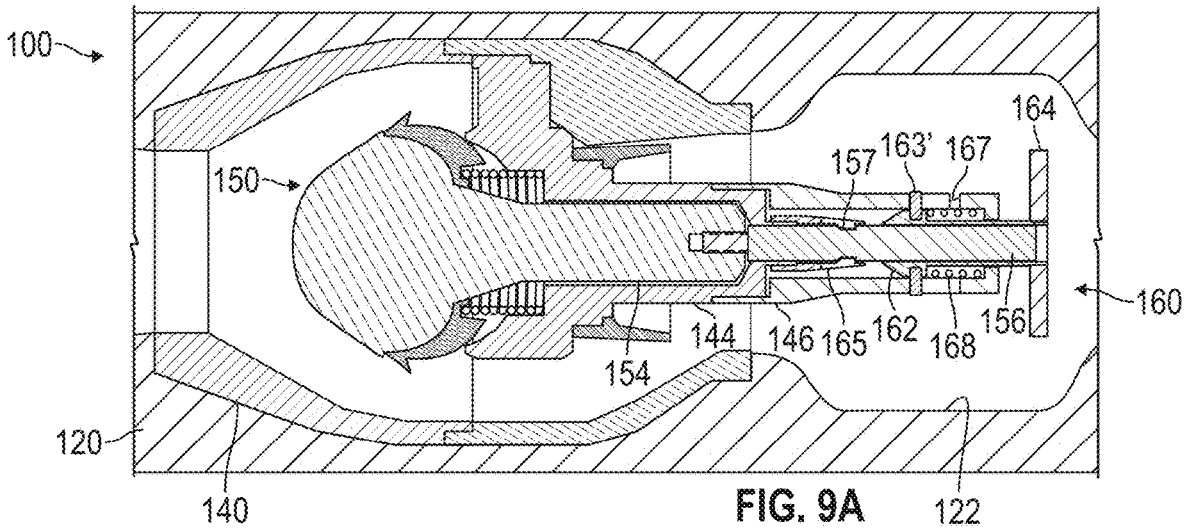
FIG. 9A illustrates the poppet valve of the autofill float assembly of FIG. 8 in a run-in condition.
Figure 9B:
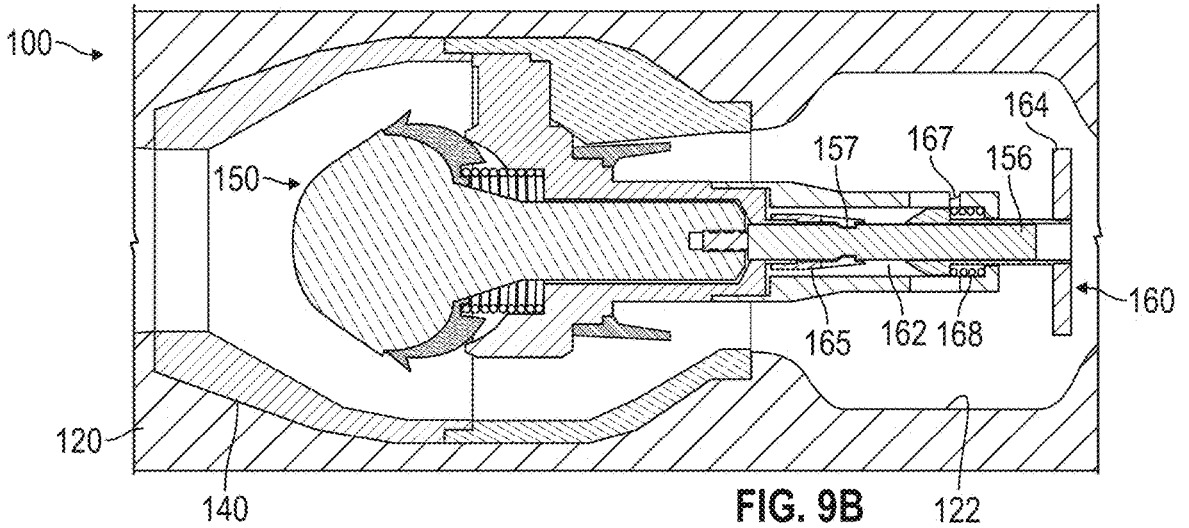
FIG. 9B illustrates the poppet valve of the autofill float assembly of FIG. 8 in a release condition.
Figure 9C:
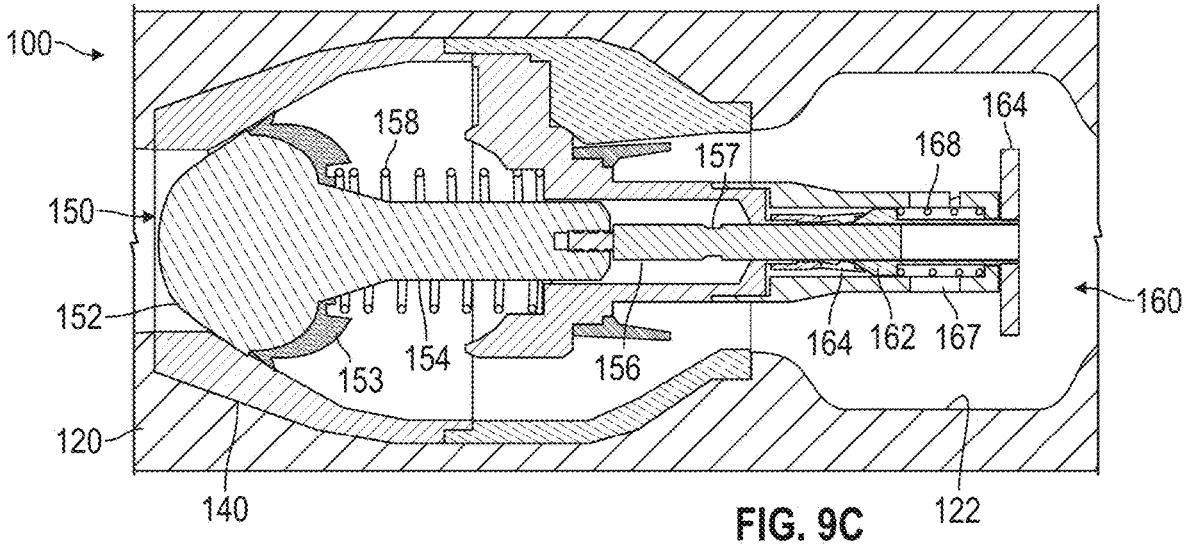
FIG. 9C illustrates the poppet valve of the autofill float assembly of FIG. 8 in a converted condition.

FIGS. 9A-9C illustrate the poppet valve 130 of the autofill float assembly 100 of FIG. 8 in a run-in condition, a release condition, and a converted condition. As shown in FIG. 9A, the autofill float assembly 100 in the run-in (autofill) condition allows flow to pass in both upbore and downbore directions. The fingers of the collet 165 engaged in the slot 157 of the poppet 150 (i.e., in the stem extension 156) keeps the poppet 150 in the open position.

Sufficient downbore flow acting against the surface area 164 moves the sleeve 162 against the bias of the spring 168 so that the sleeve 162 moves. The guide pins 163' ride in the guide slot 167 so the sleeve 162 can turn and ride in a longer portion of the guide slot 167. Once freed, the sleeve 162 moves along the stem extensions 156 as shown in FIG. 5B. The guide pins (163') are no longer visible on the sleeve 162, which has turned so the guide pins (163') can ride along another portion of the guide slots 167. When the downbore flow is relieved as shown in FIG. 9C, the poppet 150 can be biased closed by the spring 158. The sleeve 162 of the interlock 160 can be shifted by its spring 168 so the sleeve 162 expands the fingers of the collet 165 from the slot 157. (The guide pins 163' can ride along a longer portion of the J-slots 167.) The poppet 150 is now released from the interlock 160.

Because the extended features of the interlock and disrupt flow and restrict flow downstream of the poppet valve 130, the flow passage 122 downstream of the poppet valve 130 may be increased. The guide pins 163' can prevent the sleeve 162 from rotating unless the guide pins 163' reach the transition at the lower end of the guide slot 167. The sleeve 162 may be inactivated from moving again when downbore flow is experienced. Different configurations can be used to achieve this purpose. For example, a snap ring, lip and detent arrangement, ratchet arrangement, or the like (not shown) may fix the sleeve 162 in an inactive state on the outer cover 146 once the collet 165 is released from the slot 157.

Figure 10:
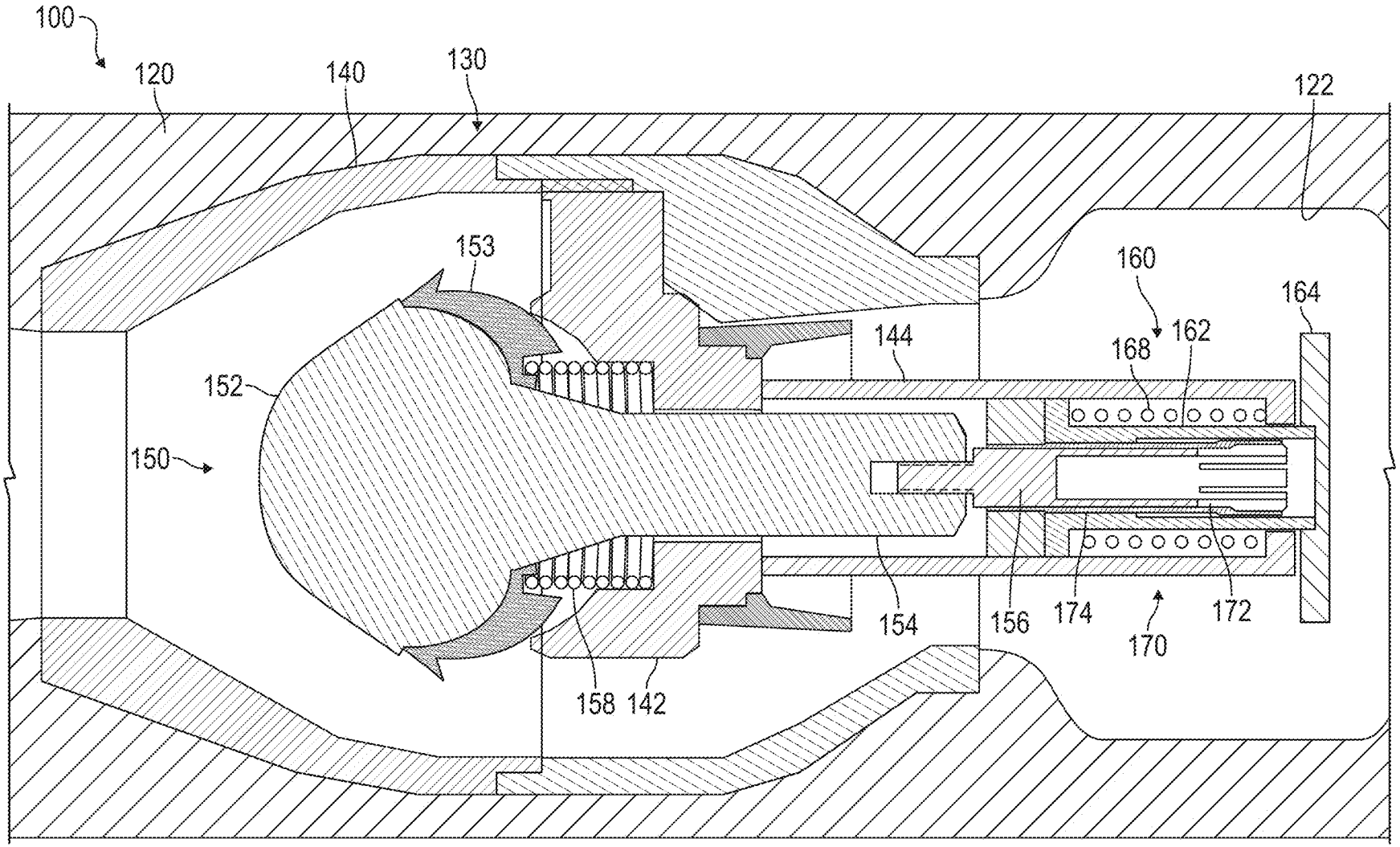
FIG. 10 illustrates a portion of an autofill float assembly having a poppet valve and a fourth configuration of the release mechanism of the present disclosure.

In another example, FIG. 10 illustrates a detailed view of an autofill float assembly 100 having a poppet valve 130 with a fourth configuration for the interlock 160. As shown, the body 161 includes a sleeve 162 disposed on the support 140. The sleeve 162 can be housed inside a rim 144 of the support ledge 142, and the sleeve 162 can have a surface area 164 (e.g., a disc, a plate, or the like) affixed to its end to provide the surface area for fluid flow.

The interlock 160 includes a collet and wedge arrangement 170 arranged between the sleeve 162 and the poppet 150. A collet 172 is movable relative to wedged sleeve 174 in response to the movement of the sleeve 162. In this example, the poppet 150 includes the collet 172 as part of the stem extension 156, and the sleeve 162 includes the wedged sleeve 174. A reverse arrangement can also be used in which the sleeve 162 includes a collet 172 and the poppet 150 has the wedged sleeve 174.

Figure 11A:
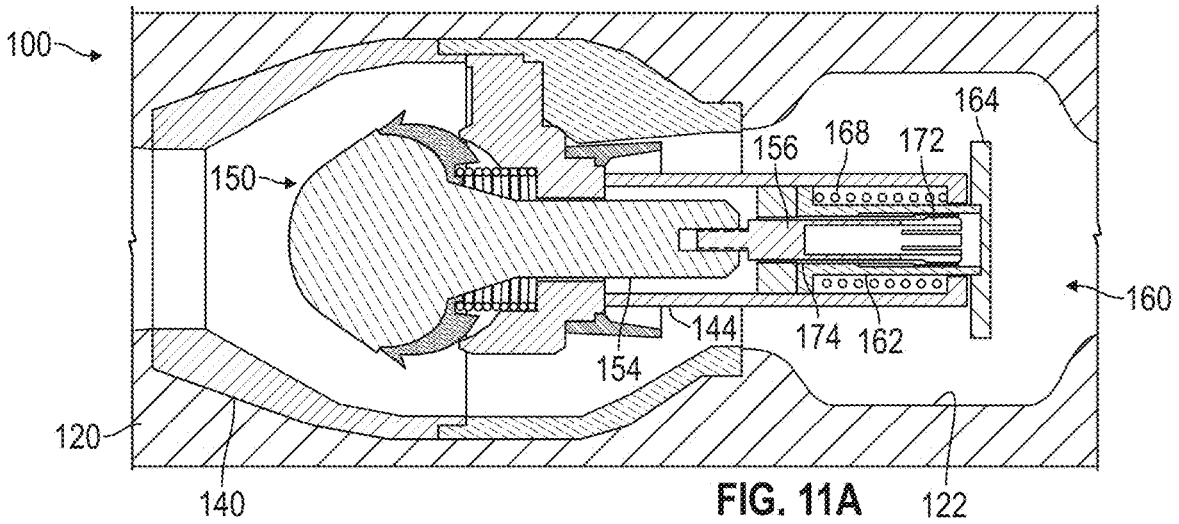
FIG. 11A illustrates the poppet valve of the autofill float assembly of FIG. 10 in a run-in condition.
Figure 11B:
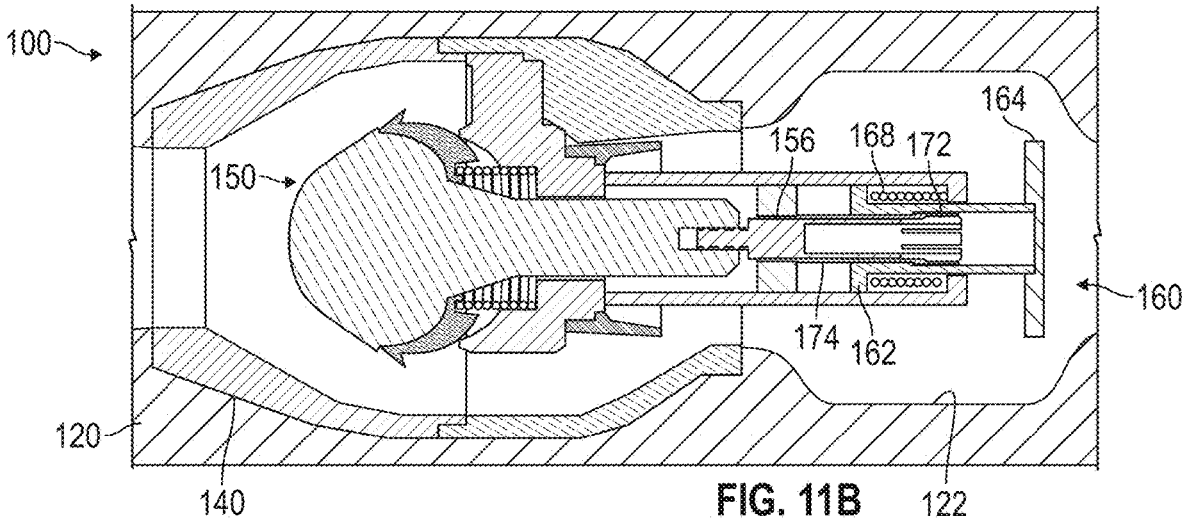
FIG. 11B illustrates the poppet valve of the autofill float assembly of FIG. 10 in a release condition.
Figure 11C:
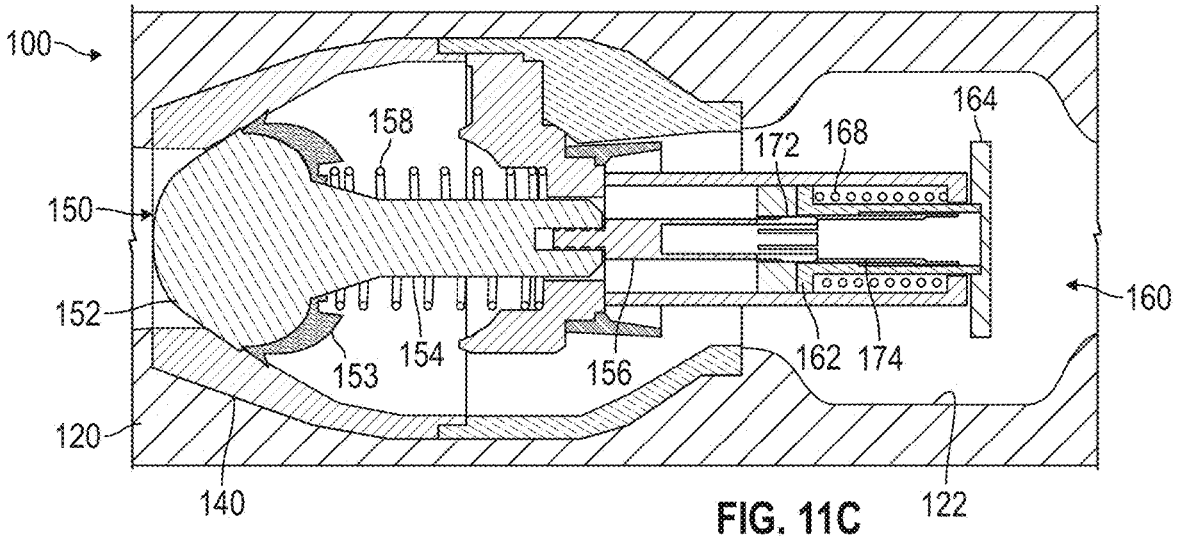
FIG. 11C illustrates the poppet valve of the autofill float assembly of FIG. 10 in a converted condition.

FIGS. 11A-11C illustrate the poppet valve 130 of the autofill float assembly of FIG. 10 in a run-in condition, a release condition, and a converted condition. As shown in FIG. 11A, the autofill float assembly 100 in the run-in (autofill) condition allows flow to pass in both upbore and downbore directions. The collet 172 and wedged sleeve 174 are engaged to keep the poppet 150 in the open position.

Sufficient downbore flow acting against the surface area 164 moves the sleeve 162 against the bias of the spring 168 so that the sleeve 162 moves downbore as shown in FIG. 11B. The downbore movement of the sleeve 162 eventually engages the wedged sleeve 174 so the fingers of the collet 172 compress inward and release from the wedged slot or surface of the wedged sleeve 174. The poppet 150 is thereby released. When the downbore flow is relieved as shown in FIG. 11C, the poppet 150 can be biased closed by the spring 158. The sleeve 162 of the interlock 160 can be shifted by its spring 168, but the collet 172 is no longer engaged with the wedged sleeve 174, which has the wedged slot or surface to engage the collet 172.

Because the extended features of the interlock and disrupt flow and restrict flow downstream of the poppet valve 130, the flow passage 122 downstream of the poppet valve 130 may be increased. Splines, tracks, or other features can prevent the outer sleeve 162*b* from rotating. The sleeve 162 may be inactivated from moving again when downbore flow is experienced. Different configurations can be used to achieve this purpose. For example, a snap ring, lip and detent arrangement, ratchet arrangement, or the like (not shown) may fix the sleeve 162 in an inactive state on the support (i.e., rim 144) once the collet 172 is released.

Configurations of the present disclosure may be characterized by the following:

1. A float assembly (100) for use on a tubing string having a throughbore for fluid flow, the float assembly (100) comprising:

a housing (110) configured to couple to the tubing string, the housing (110) defining a flow passage (122) therein, the flow passage (122) communicating with the throughbore of the tubing string and having a seat (145); and a valve (130) comprising:

a support (140) disposed in the flow passage (122);

a primary biasing element (158) disposed on the support (140);

a poppet (150) movably disposed on the support (140) and being biased by the primary biasing element (158) from an opened position to a closed position relative to the seat (145), the poppet (150) in the opened position being disengaged from the seat (145) and being configured to permit fluid flow through the flow passage (122), the poppet (150) in the closed position being engaged with the seat (145) and being configured to prevent fluid flow in an upbore direction through the flow passage (122); and an interlock (160) arranged relative to the poppet (150) and the support (140) and having a surface area (164) and a secondary biasing element (168), the surface area (164) being exposed to fluid flow in the flow passage (122), the interlock (160) being activatable from a locked state to an unlocked state in response to a level of fluid flow in a downbore direction against the surface area (164), the interlock (160) in the locked state being configured to hold the poppet (150) in the opened position, the secondary biasing element (168) disposed between the support (140) and the interlock (160) and biasing the interlock (160) to the locked state, the interlock (160) in the unlocked state being configured to release the poppet (150) biased toward the closed position by the primary biasing element (158).

2. The float assembly of Clause 1, wherein the poppet (150) defines at least one slot (157); and wherein the interlock (160) comprises:

a sleeve (162) disposed on the support (140) and being movable at least from the locked state to the unlocked state, the secondary biasing element (168) being engaged between the sleeve (162) and the support (140) and biasing the sleeve (162) to the locked state; and at least one dog (166) disposed between the sleeve (162) and the poppet (150) and being movable relative to the at least one slot (157) in response to the sleeve (162) in the locked state and the unlocked state.

3. The float assembly of Clause 1, wherein the interlock (160) comprises:

a sleeve (162) disposed on the support (140) and being movable at least from the locked state to the unlocked state, the secondary biasing element (168) being engaged between the sleeve (162) and the support (140) and biasing the sleeve (162) to the locked state; and a collet (165) and a slot (157) arranged between the sleeve (162) and the poppet (150), the collet (165) being disengaged from the slot (157) in response to the sleeve (162) in the unlocked state.

4. The float assembly of Clause 1, wherein the interlock (160) comprises:

an inner sleeve (162*a*) disposed on the poppet (150) and being connected by a releasable connection (163, 172) to the poppet (150); and an outer sleeve (162*b*) disposed on the inner sleeve (162*a*) and being movable at least from the locked state to the unlocked state, the secondary biasing element (168) being engaged between the outer sleeve (162*b*) and the support (140) and biasing the outer sleeve (162*b*) to the locked state, the outer sleeve (162*b*) moved to the unlocked state being configured to urge the inner sleeve (162*a*) and the releasable connection (163, 172) to release from one another.

5. The float assembly of Clause 4, wherein the releasable connection (163) comprises:

a shear wire disposed laterally through the inner sleeve (162*a*) and the poppet (150); and wherein the outer sleeve (162*b*) moved to the unlocked state is configured to urge the inner sleeve (162*a*) to release from the shear wire (163); or a collet (172) and a wedged slot, the collet (172) disposed on the poppet (150), the wedged slot disposed on the inner sleeve (174), the wedged slot configured to releasably engage the collet (172) of the poppet (150) in the opened position; and wherein the outer sleeve (162) moved to the unlocked state is configured to urge the inner sleeve (174) to release the collet (172) on the poppet (150) from the wedged slot on the inner sleeve (174).

6. The float assembly of Clause 1, wherein the poppet (150) defines at least one slot (157); and wherein the interlock (160) comprises:

a sleeve (162) arranged relative to the poppet (150) and the support (140) and having the surface area (164) exposed to fluid flow in the flow passage (122), the sleeve (162) being movable at least from a contracted position for the locked state to an extended position for the unlocked state in response to the level of fluid flow in the downbore direction acting against the surface area (164) of the sleeve (162), the sleeve (162) being biased to the contracted position by the secondary biasing element (168) disposed between the support (140) and the sleeve (162); and at least one dog (166) disposed between the sleeve (162) and the poppet (150) and being movable relative to the at least one slot (157) in response to the sleeve (162) in the contracted position to the extended position, the at least one dog (166) with the sleeve (162) in the contracted position being engaged with the slot (157) of the poppet (150) in the opened position, the at least one dog (166) with the sleeve (162) in the extended position being configured to disengage from the at least one slot (157) of the poppet (150).

7. The float assembly of Clause 1, wherein the interlock (160) comprises:

an inner sleeve (162*a*) arranged relative to the poppet (150) and the support (140), the inner sleeve (162*a*) being connected by a releasable connection (163) to the poppet (150); and an outer sleeve (162*b*) arranged relative to the poppet (150) and the support (140), the outer sleeve (162*b*) disposed on the inner sleeve (162*a*) and having the surface area (164) exposed to fluid flow in the flow passage (122), the outer sleeve (162*b*) being movable at least from a contracted position for the locked state to an extended position for the unlocked state in response to the level of fluid flow in the downbore direction acting against the surface area (164) of the outer sleeve (162*b*), the outer sleeve (162*b*) being biased to the contracted position by the secondary biasing element (168) disposed between the support (140) and the outer sleeve (162*b*), the outer sleeve (162*b*) moved to the extended position being configured to urge the inner sleeve (162*a*) to release from the releasable connection (163).

8. The float assembly of Clause 1, wherein the poppet (150) defines a slot (157); and wherein the interlock (160) comprises:

a sleeve (162) arranged relative to the poppet (150) and the support (140) and having the surface area (164) exposed to fluid flow in the flow passage (122), the sleeve (162) being movable at least from a first position for the locked state to a second position for the unlocked state in response to the level of fluid flow in the downbore direction acting against the surface area (164) of the sleeve (162), the sleeve (162) being biased to the second position by the secondary biasing element (168) disposed between the support (140) and the sleeve (162); and a collet (165) arranged between the sleeve (162) and the poppet (150), the collet (165) being movable relative to the slot (157) in response to the sleeve (162) moved from the first position to the second position, the collet (165) with the sleeve (162) in the first position being engaged with the slot (157) of the poppet (150) in the closed position, the collet (165) with the sleeve (162) in the second position being disengaged from the slot (157) of the poppet (150).

9. The float assembly of Clause 8, where the support (140) defines a guide slot (167); and wherein the sleeve (162) comprises a guide pin (163') disposed in the guide slot (167), the guide pin (163') being disposed in a first portion of the guide slot (167) and being configured to limit the sleeve (162) to the first position relative to the collet (165), the guide pin (163') being disposed in a second portion of the guide slot (167) and being configured to release the sleeve (162) to the second position against the collet (165).

10. The float assembly of Clause 1, wherein the poppet (150) comprises a collet (172); and wherein the interlock (160) comprises:

an inner sleeve (174) arranged relative to the poppet (150) and the support (140) and having a wedged slot, the wedged slot configured to releasably engage the collet (172) of the poppet (150) in the opened position; and an outer sleeve (162) arranged relative to the poppet (150) and the support (140), the outer sleeve (162) disposed on the inner sleeve (174) and having the surface area (164) exposed to fluid flow in the flow passage (122), the outer sleeve (162) being movable from a retracted position for the locked state of the interlock (160) to an extended position for the unlocked state of the interlock (160) in response to the level of fluid flow in the downbore direction acting against the surface area (164) of the outer sleeve (162), the outer sleeve (162) being biased to the retracted position by the secondary biasing element (168) disposed between the support (140) and the outer sleeve (162), the outer sleeve (162) moved to the extended position being configured to urge the inner sleeve (174) to release the collet (172) on the poppet (150) from the wedged slot on the inner sleeve (174).

11. The float assembly of any one of Clauses 1 to 10, wherein the surface area (164) of the interlock (160) comprises a disc, a plate, or a fin;

wherein the method further comprises a second valve (130) comprising a second support (140), a second poppet (150), and a second interlock (160); or wherein the housing (110) comprises a filler material (120) disposed in an interior of the housing (110), the filler material (120) defining a portion of the flow passage (122); and wherein the support (140) of the valve (130) comprises:

an insert (141) disposed in the filler material (120) and defining a chamber (143), the chamber (143) having the seat (145) and communicating with the flow passage (122); and a base disposed in the chamber (143), the base having the poppet (150) and the primary biasing element (158) disposed thereon, the poppet (150) being biased by primary biasing element (158) toward the seat (145).

12. A method used for a tubing string in a wellbore (10), the tubing string having a throughbore for fluid flow, the method comprising:

deploying the tubing string in the wellbore (10) while allowing fluid flow in an upbore direction and a downbore direction though a poppet valve (130) biased with a primary biasing element (158) by holding the biased poppet valve (130) in a bidirectional state with an interlock (160) biased by a secondary biasing element (168) to a locked state; and restricting fluid flow to only the downbore direction through the throughbore by:

pumping fluid flow in the downbore direction at a predetermined level against a surface area (164) of the interlock (160);

releasing the interlock (160) from the locked state to an unlocked state in response to the fluid flow at the predetermined level acting against the surface area (164) of the interlock (160);

disengaging the biased poppet valve (130) from the interlock (160) in the unlocked state; and allowing fluid flow only in the downbore direction though the biased poppet valve (130) disengaged from the interlock (160).

13. The method of Clause 12, wherein allowing fluid flow in the upbore direction and the downbore direction though the biased poppet valve (130) held in the bidirectional state by the interlock (160) comprises preventing a poppet (150) of the biased poppet valve (130) in a opened position from moving to a closed position by holding the poppet (150) in the opened position with the interlock (160), the poppet (150) in the opened position permitting fluid flow through the biased poppet (150) valve (130) in the upbore direction and the downbore direction, the poppet (150) in the closed position permitting fluid flow in the downbore direction and restricting fluid flow in the upbore direction.

14. The method of Clause 12, wherein releasing the interlock (160) and disengaging the biased poppet valve (130) comprises:

moving a body (161) of the interlock (160) against the secondary biasing element (168) in response to the predetermined level of fluid flow in the downbore direction acting against the surface area (164) of the body (161);

converting the interlock (160) in response to the movement of the body (161) from the locked state engaged with the biased poppet valve (130) in a first position to the unlocked state disengaged from the poppet (150); and biasing the poppet (150) toward a second position with the primary biasing element (158).

15. The method of Clause 12, wherein releasing the interlock (160) and disengaging the biased poppet valve (130) comprises:

moving a sleeve (162) of the interlock (160) against the secondary biasing element (168) in response to the predetermined level of fluid flow in the downbore direction acting against the surface area (164) of the sleeve (162);

disengaging at least one dog (166) from at least one slot (157) in response to the movement of the sleeve (162), the at least one dog and the at least one slot (157) arranged between the sleeve (162) and the biased poppet valve (130) in a closed position; and biasing the biased poppet valve (130) toward an opened position with the primary biasing element (158).

16. The method of Clause 12, wherein releasing the interlock (160) and disengaging the biased poppet valve (130) from the interlock (160) comprises:

moving a sleeve (162) of the interlock (160) against the secondary biasing element (168) in response to the predetermined level of fluid flow in the downbore direction acting against the surface area (164) of the sleeve (162);

disengaging a collet (165, 172) from at least one slot or surface (157, 174) in response to the movement of the sleeve (162), the collet (165, 172) and the at least one slot or surface (157, 174) arranged between the sleeve (162) and the biased poppet valve (130) in a first position; and biasing the biased poppet valve (130) toward a second position with the primary biasing element (158).

17. The method of Clause 12, wherein releasing the interlock (160) and disengaging the biased poppet valve (130) comprises:

urging an outer sleeve (162*b*, 162) of the interlock (160) against the secondary biasing element (168) against an inner sleeve (162*a*, 174) of the interlock (160) in response to the predetermined level of fluid flow in the downbore direction acting against the surface area (164) of the outer sleeve (162*b*, 162);

releasing a releasable connection (163, 172) between the inner sleeve (162*a*, 174) and the biased poppet valve (130) in response to the outer sleeve (162*b*, 162) urged against the inner sleeve (162*a*, 174); and biasing the biased poppet valve (130) toward a second position with the primary biasing element (158).

Any relative terms, such as "above" and "below," "uphole" and "downhole," "upbore" and "downbore," and the like, are used herein without respect to whether the wellbore is vertical or horizontal. These and other relative terms are used to improve understanding. As one skilled in the art will understand, the subject matter of the present disclosure is applicable to horizontal and vertical wells.

The foregoing description of preferred and other configurations is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A float assembly for use on a tubing string having a throughbore for fluid flow, the float assembly comprising:

a housing configured to couple to the tubing string, the housing defining a flow passage therein, the flow passage communicating with the throughbore of the tubing string and having a seat; and a valve comprising:

a support disposed in the flow passage;

a primary biasing element disposed on the support;

a poppet movably disposed on the support and being biased by the primary biasing element from an opened position to a closed position relative to the seat, the poppet in the opened position being disengaged from the seat and being configured to permit fluid flow through the flow passage, the poppet in the closed position being engaged with the seat and being configured to prevent fluid flow in an upbore direction through the flow passage; and an interlock comprising a sleeve arranged relative to the poppet and the support and comprising a collet and a slot arranged between the sleeve and the poppet, the interlock having a surface area and a secondary biasing element, the surface area being exposed to fluid flow in the flow passage, the interlock being activatable from a locked state to an unlocked state in response to a level of fluid flow in a downbore direction against the surface area, the sleeve being movable at least from the locked state to the unlocked state, the collet being disengaged from the slot in response to the sleeve in the unlocked state, the interlock in the locked state being configured to hold the poppet in the opened position, the secondary biasing element being engaged between the support and the sleeve and biasing the sleeve to the locked state, the interlock in the unlocked state being configured to release the poppet biased toward the closed position by the primary biasing element.

2. The float assembly of claim 1, wherein the poppet defines the slot; and wherein:

the sleeve has the surface area exposed to fluid flow in the flow passage, the sleeve being movable at least from a first position for the locked state to a second position for the unlocked state in response to the level of fluid flow in the downbore direction acting against the surface area of the sleeve, the sleeve being biased to the second position by the secondary biasing element disposed between the support and the sleeve; and the collet is movable relative to the slot in response to the sleeve moved from the first position to the second position, the collet with the sleeve in the first position being engaged with the slot of the poppet in the closed position, the collet with the sleeve in the second position being disengaged from the slot of the poppet.

3. The float assembly of claim 2, where the support defines a guide slot; and wherein the sleeve comprises a guide pin disposed in the guide slot, the guide pin being disposed in a first portion of the guide slot and being configured to limit the sleeve to the first position relative to the collet, the guide pin being disposed in a second portion of the guide slot and being configured to release the sleeve to the second position against the collet.

4. The float assembly of claim 1, wherein the poppet comprises the collet; and wherein the sleeve of the interlock comprises:

an inner sleeve having the slot, the slot being a wedged slot configured to releasably engage the collet of the poppet in the open position; and an outer sleeve disposed on the inner sleeve and having the surface area exposed to fluid flow in the flow passage, the outer sleeve being movable from a retracted position for the locked state of the interlock to an extended position for the unlocked state of the interlock in response to the level of fluid flow in the downbore direction acting against the surface area of the outer sleeve, the outer sleeve being biased to the retracted position by the secondary biasing element disposed between the support and the outer sleeve, the outer sleeve moved to the extended position being configured to urge the inner sleeve to release the collet on the poppet from the wedged slot on the inner sleeve.

5. The float assembly of claim 1, further comprising a second valve comprising a second support, a second poppet, and a second interlock.

6. The float assembly of claim 1, wherein the housing comprises a filler material disposed in an interior of the housing, the filler material defining a portion of the flow passage; and wherein the support of the valve comprises:

an insert disposed in the filler material and defining a chamber, the chamber having the seat and communicating with the flow passage; and a base disposed in the chamber, the base having the poppet and the primary biasing element disposed thereon, the poppet being biased by primary biasing element toward the seat.

7. A float assembly of claim 1 for use on a tubing string having a throughbore for fluid flow, the float assembly comprising:

a housing configured to couple to the tubing string, the housing defining a flow passage therein, the flow passage communicating with the throughbore of the tubing string and having a seat; and a valve comprising:

a support disposed in the flow passage;

a primary biasing element disposed on the support;

a poppet movably disposed on the support and being biased by the primary biasing element from an opened position to a closed position relative to the seat, the poppet in the opened position being disengaged from the seat and being configured to permit fluid flow through the flow passage, the poppet in the closed position being engaged with the seat and being configured to prevent fluid flow in an upbore direction through the flow passage, wherein the poppet defines at least one slot; and an interlock arranged relative to the poppet and the support and having a surface area and a secondary biasing element, the surface area being exposed to fluid flow in the flow passage, wherein the interlock comprises a sleeve arranged relative to the poppet and the support and comprises at least one dog disposed between the sleeve and the poppet, the interlock being activatable from a locked state to an unlocked state in response to a level of fluid flow in a downbore direction against the surface area, the sleeve being movable at least from the locked state to the unlocked state, the secondary biasing element being engaged between the sleeve and the support and biasing the sleeve to the locked state, the at least one dog being movable relative to the at least one slot in response to the sleeve in the locked state and the unlocked state, the interlock in the locked state being configured to hold the poppet in the opened position, the interlock in the unlocked state being configured to release the poppet biased toward the closed position by the primary biasing element.

8. The float assembly of claim 7, wherein:

the sleeve has the surface area exposed to fluid flow in the flow passage, the sleeve being movable at least from a contracted position for the locked state to an extended position for the unlocked state in response to the level of fluid flow in the downbore direction acting against the surface area of the sleeve, the sleeve being biased to the contracted position by the secondary biasing element disposed between the support and the sleeve; and the at least one dog is movable relative to the at least one slot in response to the sleeve in the contracted position moved to the extended position, the at least one dog with the sleeve in the contracted position being engaged with the at least one slot of the poppet in the opened position, the at least one dog with the sleeve in the extended position being configured to disengage from the at least one slot of the poppet.

9. The float assembly of claim 7, wherein the surface area of the interlock comprises a disc, a plate, or a fin.

10. The float assembly of claim 7, further comprising a second valve comprising a second support, a second poppet, and a second interlock.

11. The float assembly of claim 7, wherein the housing comprises a filler material disposed in an interior of the housing, the filler material defining a portion of the flow passage; and wherein the support of the valve comprises:

an insert disposed in the filler material and defining a chamber, the chamber having the seat and communicating with the flow passage; and a base disposed in the chamber, the base having the poppet and the primary biasing element disposed thereon, the poppet being biased by primary biasing element toward the seat.

12. A float assembly for use on a tubing string having a throughbore for fluid flow, the float assembly comprising:

a housing configured to couple to the tubing string, the housing defining a flow passage therein, the flow passage communicating with the throughbore of the tubing string and having a seat; and a valve comprising:

a support disposed in the flow passage;

a primary biasing element disposed on the support;

a poppet movably disposed on the support and being biased by the primary biasing element from an opened position to a closed position relative to the seat, the poppet in the opened position being disengaged from the seat and being configured to permit fluid flow through the flow passage, the poppet in the closed position being engaged with the seat and being configured to prevent fluid flow in an upbore direction through the flow passage; and an interlock arranged relative to the poppet and the support and having a surface area and a secondary biasing element, the surface area being exposed to fluid flow in the flow passage, the interlock being activatable from a locked state to an unlocked state in response to a level of fluid flow in a downbore direction against the surface area, wherein the interlock comprises an inner sleeve and an outer sleeve, the inner sleeve arranged relative to the poppet and the support and being connected by a releasable connection to the poppet, the outer sleeve disposed on the inner sleeve and being movable at least from the locked state to the unlocked state, the secondary biasing element being engaged between the outer sleeve and the support and biasing the outer sleeve to the locked state, the outer sleeve moved to the unlocked state being configured to urge the inner sleeve and the releasable connection to release from one another, the interlock in the locked state being configured to hold the poppet in the opened position, the interlock in the unlocked state being configured to release the poppet biased toward the closed position by the primary biasing element.

13. The float assembly of claim 12, wherein the releasable connection comprises a shear wire disposed laterally through the inner sleeve and the poppet; and wherein the outer sleeve moved to the unlocked state is configured to urge the inner sleeve to release from the shear wire.

14. The float assembly of claim 13, wherein the releasable connection comprises a collet and a wedged slot, the collet disposed on the poppet, the wedged slot disposed on the inner sleeve, the wedged slot configured to releasably engage the collet of the poppet in the opened position; and wherein the outer sleeve moved to the unlocked state is configured to urge the inner sleeve to release the collet on the poppet from the wedged slot on the inner sleeve.

15. The float assembly of claim 12, wherein the outer sleeve has the surface area exposed to fluid flow in the flow passage, the outer sleeve being movable at least from a contracted position for the locked state to an extended position for the unlocked state in response to the level of fluid flow in the downbore direction acting against the surface area of the outer sleeve, the outer sleeve being biased to the contracted position by the secondary biasing element disposed between the support and the outer sleeve, the outer sleeve moved to the extended position being configured to urge the inner sleeve to release from the releasable connection.

16. The float assembly of claim 15, wherein the releasable connection comprises a shear wire disposed laterally through the inner sleeve and the poppet.

17. A method used for a tubing string in a wellbore, the tubing string having a throughbore for fluid flow, the method comprising:

deploying the tubing string in the wellbore while allowing fluid flow in an upbore direction and a downbore direction though a poppet valve biased with a primary biasing element by holding the biased poppet valve in an open position with an interlock biased by a secondary biasing element to a locked state; and restricting fluid flow to only the downbore direction through the throughbore by:

pumping fluid flow in the downbore direction at a predetermined level against a surface area of the interlock;

releasing the interlock from the locked state to an unlocked state by moving a body of the interlock against the secondary biasing element in response to the fluid flow at the predetermined level acting in the downbore direction against the surface area of the body of the interlock;

disengaging the biased poppet valve from the interlock in the unlocked state by converting the interlock in response to the movement of the body from the locked state engaged with the biased poppet valve in the open position to the unlocked state disengaged from the biased poppet valve;

biasing the biased poppet valve toward a closed position with the primary biasing element; and allowing fluid flow only in the downbore direction though the biased poppet valve disengaged from the interlock.

18. The method of claim 17, wherein allowing fluid flow in the upbore direction and the downbore direction though the biased poppet valve held in the open position by the interlock comprises preventing a poppet of the biased poppet valve in the open position from moving to the closed position by holding the poppet in the open position with the interlock, the poppet in the open position permitting fluid flow through the biased poppet valve in the upbore direction and the downbore direction, the poppet in the closed position permitting fluid flow in the downbore direction and restricting fluid flow in the upbore direction.

19. The method of claim 17, wherein the body of the interlock comprises a sleeve; wherein the interlock comprises at least one dog and at least one slot; and wherein moving the body comprises moving the sleeve of the interlock against the secondary biasing element in response to the predetermined level of fluid flow in the downbore direction acting against the surface area of the sleeve; and converting the interlock comprises disengaging the at least one dog from the at least one slot in response to the movement of the sleeve, the at least one dog and the at least one slot arranged between the sleeve and the biased poppet valve in the open position.

20. The method of claim 17, wherein the body of the interlock comprises a sleeve; wherein the interlock comprises a collet and at least one slot; and wherein moving the body comprises moving the sleeve of the interlock against the secondary biasing element in response to the predetermined level of fluid flow in the downbore direction acting against the surface area of the sleeve; and converting the interlock comprises disengaging the collet from the at least one slot in response to the movement of the sleeve, the collet and the at least one slot arranged between the sleeve and the biased poppet valve in the closed position.

21. The method of claim 17, wherein the body of the interlock comprises an inner sleeve and an outer sleeve; wherein the interlock comprises a releasable connection; and wherein:

moving the body comprises urging the outer sleeve of the interlock against the secondary biasing element against the inner sleeve of the interlock in response to the predetermined level of fluid flow in the downbore direction acting against the surface area of the outer sleeve; and converting the interlock comprises releasing the releasable connection between the inner sleeve and the biased poppet valve in response to the outer sleeve urged against the inner sleeve.

* * * * *